US007374274B2

(12) United States Patent
Cornell

(10) Patent No.: US 7,374,274 B2
(45) Date of Patent: May 20, 2008

(54) METHOD OF OPERATING A MICROELECTROMECHANICAL INKJET EJECTOR TO ACHIEVE A PREDETERMINED MECHANICAL DEFLECTION

(75) Inventor: Robert W. Cornell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 407 days.

(21) Appl. No.: 10/924,386

(22) Filed: Aug. 20, 2004

(65) Prior Publication Data

US 2006/0038852 A1 Feb. 23, 2006

(51) Int. Cl.
*B41J 2/04* (2006.01)

(52) U.S. Cl. ..... 347/54

(58) Field of Classification Search ..... 347/54, 347/68–72, 20, 40, 44, 47, 50; 29/890.1; 310/328–330

See application file for complete search history.

(56) References Cited

U.S. PATENT DOCUMENTS

| | | | | |
|---|---|---|---|---|
| 5,838,351 | A | 11/1998 | Weber | 347/85 |
| 6,435,666 | B1 | 8/2002 | Trauerhicht et al. | 347/54 |
| 6,460,972 | B1 | 10/2002 | Trauernicht et al. | 347/54 |
| 6,464,341 | B1 | 10/2002 | Furlani et al. | 347/54 |
| 6,561,627 | B2 | 5/2003 | Jarrold et al. | 347/54 |
| 6,572,220 | B1 | 6/2003 | Ross et al. | 347/55 |
| 6,588,884 | B1 * | 7/2003 | Furlani et al. | 347/54 |
| 6,598,960 | B1 | 7/2003 | Cabal et al. | 347/54 |
| 6,631,979 | B2 | 10/2003 | Lebens et al. | 347/54 |
| 6,644,786 | B1 | 11/2003 | Lebens | 347/54 |
| 6,685,303 | B1 | 2/2004 | Trauernicht et al. | 347/54 |
| 6,721,020 | B1 | 4/2004 | Delametter et al. | 347/54 |
| 2004/0036739 | A1 | 2/2004 | Delametter et al. | 347/54 |

FOREIGN PATENT DOCUMENTS

| | | |
|---|---|---|
| EP | 1391305 | 2/2004 |

OTHER PUBLICATIONS

N.D. Mankame et al., "Comprehensive thermal modelling and characterization of an electro-thermal-compliant microactuator," J. Micromech. Microeng 11., pp. 452-462, 2001.

D.O. Popa, et al., "Dynamic modeling and input shaping of thermal bimorph MEMS actuators," Proceedings of IEEE Int'l Conference on Robotics and Automation, Taipei, Taiwan, Sep. 2003, pp. 1470-1475.

N. Manakame et al., "The effect of thermal boundary conditions and scaling on electro-thermal-compliant micro devices," Tech. Proceedings of the 2000 Int'l Conference on Modeling and Simulation of Microsystems, MSM 2000, pp. 609-612.

M. Chiao et al., "Self-buckling of micromachined beams under resistive heating," J. Microelectromechanical Systems, vol. 9, No. 1, Mar. 2000, pp. 146-151.

R.R. Allen et al., "Thermodynamics and Hydrodynamics of Thermal Ink Jets," Journal, May 1985, pp. 21-27.

* cited by examiner

*Primary Examiner*—Juanita D. Stephens
(74) *Attorney, Agent, or Firm*—Taft Stettinius & Hollister

(57) ABSTRACT

The present invention is directed to printing a pattern, such as an image or other indicia, onto a surface, and more specifically to printing a pattern onto a surface utilizing at least one microelectromechanical system (MEMS) actuator. The present invention in exemplary form makes use of Joule heating to actuate a beam that is capable of displacing ink from a chamber and onto a surface of a print medium. The invention includes methods for designing, fabricating, and operating a MEMS actuator in accordance with the teachings discussed herein.

43 Claims, 18 Drawing Sheets

R(Ohm) = 60.169
Vhtr(V) = 7.00
Ehtr(μJ) = 1.629
ΔTmax(C) = 167

R(Ohm) = 67.596
Vhtr(V) = 7.42
Ehtr(μJ) = 1.629
ΔTmax(C) = 589

ΔXmax (μm) = .103
ΔYmax (μm) = 1.055
ΔV(pl) = 1.933

Δ Xmax (μ m) = .151
Δ Ymax (μ m) = 1.191
Δ V(pl) = 1.629

ΔT FIELD AT THE END OF THE FIRE PULSE
ΔT = 25 C BETWEEN CONTOURS

METHOD OF OPERATING A MICROELECTROMECHANICAL INKJET EJECTOR TO ACHIEVE A PREDETERMINED MECHANICAL DEFLECTION

BACKGROUND

1. Field of the Invention

The present invention is directed to printing a pattern, such as an image or other indicia, onto a surface, and more specifically to printing a pattern onto a surface utilizing at least one microelectromechanical system (MEMS) actuator. The present invention in exemplary form makes use of Joule heating to actuate a beam that is capable of displacing ink from a chamber and onto a surface of a print medium.

2. Background of the Invention

There are two basic types of microelectromechanical system (MEMS) actuators: single material actuators and composite material actuators. Both types of actuators are based upon the principle of Joule heating to thermally expand a micromachined material to generate the requisite displacement.

Referencing FIG. 14, the well-known Guckel actuator is an example of a single material MEMS actuator 10. The actuator 10 may be micromachined from silicon or polysilicon and when a voltage is applied at the anchored end of the device, the thin arm 12 has a much higher current density than the wide arm 14. The thin arm 12 becomes elevated in temperature to a greater degree than the wide arm 14 as a result of the current density and thus, the thin arm 14 will tend expand more than the wide arm 16. The result is differential expansion between the thin arm 14 and wide arm 16 providing a net movement toward the wide arm 16.

Exemplary single material actuators have been reported as comprising a 1575 Ohm actuator, 2200 microns long, with thin/wide arms being 40/255 microns wide, respectively (University of Pennsylvania, NSF Grant DMI-97-33196). When 9 volts was applied across this single material actuator, Joule heating caused an average temperature rise of approximately 230° C. The temperature difference between the thin and wide arms was approximately 50° C. and the differential thermal expansion produced a net deflection or movement of about 8 microns.

Another example of a single material MEMS actuator is disclosed in a NSF Grant ECS-9734421 (University of California at Berkeley). In this example, the actuator is micromachined from polysilicon and has dimensions of 2×2×100 microns, which each end of the actuator being mounted to an anchor point. Thermal expansion of the polysilicon causes the beam to buckle as the expansion is constrained at the ends of the beam by the anchor points. The authors reported that a continuous current of 4.2 mA through the beam caused a steady state $\Delta T$ of 900° C., resulting in a deflection of 3 microns.

In contrast to the single material examples, composite material actuators may use a beam structure consisting of two different materials having two different thermal expansion coefficients. Joule heating is used to raise the temperature of the beam and, because the two materials have different thermal expansion coefficients, a net movement in one or more directions results.

SUMMARY OF THE INVENTION

The present invention is directed to printing a pattern onto a surface, and more specifically to printing a pattern onto a surface utilizing at least one microelectromechanical system (MEMS) actuator. The present invention includes designing, fabricating, and implementing MEMS actuators that make use of Joule heating to actuate a beam capable of displacing a fluid from a reservoir and onto a surface.

It is a first aspect of the present invention to provide a method of designing a microelectromechanical fluid ejector, the method comprising: calculating current density taking into consideration three dimensional measurements of a resistor layer of the ejector, a voltage that will be supplied to the resistor layer, and material properties of the resistor layer; and designing a microelectromechanical fluid ejector using the calculated current density.

In a more detailed embodiment of the first aspect, the method further includes: calculating a pulse duration during which a microelectromechanical fluid ejector will be driven taking into consideration the current density, where the act of calculating current density takes into consideration an energy value that the microelectromechanical fluid ejector will consume while driven.

It is a second aspect of the present invention to provide a method of fabricating an apparatus for selective deposition of a fluid onto a surface, the method comprising: (a) forming a repositionable actuator by layering a first material having a first thermal expansion coefficient over a second material having a second thermal expansion coefficient, the first thermal expansion coefficient being greater than the second thermal expansion coefficient, at least one of the first material and the second material being formed to exhibit non-uniform current density between a first point and a second point spaced along a length of the repositionable actuator; and mounting the repositionable actuator to allow movement of the repositionable actuator within a reservoir, the reservoir including an orifice that is adapted to allow selective expelling of a fluid therethrough and onto a surface, where the repositionable actuator is adapted to displace more than one picoliter per microjoule.

It is a third aspect of the present invention to provide a method of operating a printing apparatus having a microelectromechanical fluid ejector operative to displace a particular volume of fluid, the method comprising: (a) monitoring print instructions regarding a pattern to be printed onto a surface; (b) determining a volume of fluid to be ejected from a predetermined nozzle of a printing apparatus based upon the pattern to be printed; and (c) manipulating a pulse width applied to a microelectromechanical fluid ejector in communication with the predetermined nozzle, in response to the act of determining the volume of fluid to be ejected, to eject a droplet of fluid having a predetermined volume onto the surface.

It is a fourth aspect of the present invention to provide a method of operating a printing apparatus having a microelectromechanical fluid ejector operative to displace a particular volume of fluid, the method comprising: (a) monitoring print instructions regarding a pattern to be printed onto a surface; (b) determining a volume of fluid to be ejected from a predetermined nozzle of a printing apparatus based upon the pattern to be printed; and (c) manipulating a voltage applied to a microelectromechanical fluid ejector in communication with the predetermined nozzle, in response to the act of determining the volume of fluid to be ejected, to eject a droplet of fluid having a predetermined volume onto the surface.

It is a fifth aspect of the present invention to provide a method of operating a microelectromechanical fluid ejector to achieve a predetermined mechanical deflection, the method comprising: (a) calculating a pulse width driving a resistor layer of a microelectromechanical fluid ejector to provide a predetermined mechanical deflection by acknowledging a voltage that will drive the microelectromechanical fluid ejector, a pertinent volume of the resistor layer, and an expected change in a temperature field of the microelectromechanical fluid ejector as a result of being driven; and (b) operating the microelectromechanical fluid ejector using the calculated pulse width to eject a droplet of fluid from a nozzle, where the droplet is within a predetermined volume range.

In yet another more detailed embodiment of the fifth aspect, the calculating act includes: (i) calculating a current density of the resistor layer; and (ii) calculating a mechanical deflection of the microelectromechanical fluid ejector utilizing at least in part the current density, the volume of the resistor layer, the voltage, the pulse width, and the expected change in the temperature field of the microelectromechanical fluid ejector.

It is a sixth aspect of the present invention to provide a method of operating a microelectromechanical fluid ejector, the method comprising: (a) calculating a cycle time of a microelectromechanical fluid ejector using a shape of the microelectromechanical fluid ejector, a current that will be used to drive the microelectromechanical fluid actuator, a pulse width of the current, and material properties of each material comprising the microelectromechanical fluid ejector; and (b) operating the microelectromechanical fluid ejector using the calculated cycle time to eject a droplet of fluid from a nozzle, where the droplet is within a predetermined volume range.

In still another more detailed embodiment of the sixth aspect, the act of operating the microelectromechanical fluid ejector includes operating the microelectromechanical fluid ejector at a frequency of about between 20 KHz to about 25 KHz.

It is a seventh aspect of the present invention to provide a thermal deformation tool for use in selective deposition of a fluid onto a surface comprising a repositionable actuator including a first material having a first thermal expansion coefficient adjacent to a second material having a second thermal expansion coefficient, the first thermal expansion coefficient being greater than the second thermal expansion coefficient, the repositionable actuator being fabricated to exhibit nonuniform current density between a first point and a second point spaced along a length of the repositionable actuator, where a point of maximum deflection of the repositionable actuator is nearer the second point than the first point, where the repositionable actuator is subjected to temperature variances causing the first material to expand or contract at a greater rate than the second material, and where the repositionable actuator is adapted to displace more than one picoliter per microjoule.

In a more detailed embodiment of the seventh aspect, the second material includes a first layer and a second layer that sandwich the first material, where a thickness of the first layer is greater than ten times a thickness of the second layer.

It is an eighth aspect of the present invention to provide an apparatus for selective deposition of a fluid onto a surface, such as that of a print medium or a substrate, the apparatus comprising: (a) an adaptable beam that includes a cross section along the length thereof comprising a first layer of a first material, a first layer of a second material, and a second layer of a first material, where a thickness of the first layer of the first material is greater than ten times a thickness of the second layer of the first material, where a thermal expansion coefficient of the second material is greater than a thermal expansion coefficient of the first material; and (b) a chamber adapted to house the adaptable beam at least partially therein, the chamber also adapted to include at least one orifice to allow expelling of a fluid from the chamber by actuation of the adaptable beam upon being subjected to temperature variances.

In a more detailed embodiment of the eighth aspect, the second material is a conductor and the first material is an insulator. In yet another more detailed embodiment, the first material comprises silicon dioxide and the second material comprises at least one of titanium and aluminum. In a further detailed embodiment, the first layer of the first material is between about 4 microns to about 5 microns and the second layer of the first material is between about 0.1 microns to about 0.4 microns. In still a further detailed embodiment, the first layer of the first material is between about 3 microns to about 7 microns and the second layer of the first material is between about 0.03 microns to about 0.6 microns. In a more detailed embodiment, the adaptable beam is adapted to displace more than one picoliter per microjoule.

It is a ninth aspect of the present invention to provide a method of fabricating an apparatus for selective deposition of a fluid onto a surface, the method comprising: (a) forming a repositionable actuator that includes at least three layers: (i) a first layer comprising a first material having a first thermal expansion coefficient, (ii) a third layer comprising a third material having a third thermal expansion coefficient, and (iii) a second layer comprising a second material having a second thermal expansion coefficient, where the second layer at least partially separates the first layer from the third layer, where a thickness of a first layer is greater than ten times a thickness of the third layer; and (b) mounting the repositionable actuator within a reservoir to allow movement of the actuator when subjected to temperature variances by resistive heating to allow selective expelling of a fluid through an orifice of the reservoir and onto a surface.

In a more detailed embodiment of the ninth aspect, the first layer and the third layer are operative to encapsulate the second layer. In yet another more detailed embodiment, the second layer at least partially interposes the first layer and the third layer. In a further detailed embodiment, the repositionable actuator is adapted to displace more than one picoliter per microjoule.

It is a tenth aspect of the present invention to provide a method of operating an apparatus for selective deposition of a fluid onto a surface, the method comprising: (a) supplying a reservoir with a fluid, the reservoir including at least one orifice to allow expelling of the fluid from the reservoir, the reservoir at least partially housing an actuator therein; and (b) resistively heating the actuator to reposition the actuator from a first position to a second position, where the second position is closer to the orifice than the first position, the actuator including a first insulating layer, a first conductive layer, and a second insulating layer, where the first insulating layer is greater than ten times a thickness of the second insulating layer and the first conductive layer at least partially separates the first insulating layer from the second insulating layer, where the first insulating layer is nearer to the orifice than the second insulating layer, and where the actuator is adapted to displace more than one picoliter per microjoule.

It is an eleventh aspect of the present invention to provide a thermal deformation tool for use in selective deposition of a fluid onto a surface comprising an adaptable beam comprising a first material having a first thermal expansion coefficient at least partially encased by a second material having a second thermal expansion coefficient, the first thermal expansion coefficient being greater than the second thermal expansion coefficient, the adaptable beam having a length greater than a width and a height thereof, a cross section along the length of the adaptable beam comprising a first layer of the first material, a first layer of the second material, and a second layer of the first material, where a thickness of the first layer of the first material is greater than ten times a thickness of the second layer of the first material.

In a more detailed embodiment of the eleventh aspect, the first material is an insulator and the second material is a conductor. In yet another more detailed embodiment, the first material comprises silicon dioxide and the second material comprises at least one of titanium and aluminum. In a further detailed embodiment, the first layer of the first material is between about 3 microns to about 7 microns and the second layer of the first material is between about 0.03 microns to about 0.7 microns. In still a further detailed embodiment, the first layer of the first material is between about 4 microns to about 5 microns and the second layer of the first material is between about 0.1 microns to about 0.4 microns. In a still another more detailed embodiment, the adaptable beam is adapted to displace more than one picoliter per microjoule.

It is a twelfth aspect of the present invention to provide a method for operating an apparatus adapted for selective deposition of a fluid onto a surface, the method comprising: oscillating a repositionable beam between a first position and a second position to allow expelling of a fluid from a chamber through an orifice by movement of the repositionable beam, the chamber being adapted to house the repositionable beam at least partially therein, and the repositionable beam comprising a first material having a first thermal expansion coefficient adjacent to a second material having a second thermal expansion coefficient, the first thermal expansion coefficient being less than the second thermal expansion coefficient, where the act of oscillating includes heating the repositionable beam such that a surface temperature of the repositionable beam does not exceed about 300 degrees Celsius.

In a more detailed embodiment of the twelfth aspect, the repositionable beam is adapted to displace more than one picoliter per microjoule.

It is a thirteenth aspect of the present invention to provide an apparatus for selective deposition of a fluid onto a surface, the apparatus comprising: (a) an oscillating beam comprising a first material having a first thermal expansion coefficient adjacent to a second material having a second thermal expansion coefficient, the first thermal expansion coefficient being less than the second thermal expansion coefficient, where the oscillating beam has a nonuniform current density and has surface pores less than between about 0.1 microns and about 0.01 microns in depth; and (b) a chamber adapted to house the adaptable beam at least partially therein, the chamber also adapted to include at least one orifice for expelling a fluid from the chamber by actuation of the oscillating beam.

In a more detailed embodiment of the thirteenth aspect, the oscillating beam includes surface pores ranging between about 0.07 microns to about 0.01 microns. In yet another more detailed embodiment, the oscillating beam includes surface pores ranging between about 0.06 microns to about 0.02 microns. In a further detailed embodiment, the oscillating beam is adapted to displace more than one picoliter per microjoule.

It is a fourteenth aspect of the present invention to provide a method of operating a microelectromechanical fluid ejector to eject a particular volume of fluid, the method comprising: (a) calculating a voltage applied to a microelectromechanical actuator to displace a predetermined volume droplet from a nozzle of a printing apparatus by factoring in a current density for each element of the microelectromechanical actuator and Joule heating for each element of the microelectromechanical actuator; and (b) applying the calculated voltage to the microelectromechanical actuator to eject a droplet of fluid from a nozzle, where the droplet is within a predetermined volume range.

In a more detailed embodiment of the fourteenth aspect, the method further includes: calculating an electric field in the microelectromechanical actuator; assigning a resistivity value to each element of the microelectromechanical actuator; calculating a current density distribution of the microelectromechanical actuator using the resistivity and electric field; calculating a current through the microelectromechanical actuator based upon the current density; and calculating a transient temperature field of the microelectromechanical actuator using the current density, where the transient temperature field is factored into to determine the Joule heating. In yet another more detailed embodiment, the act of calculating the electric field in the microelectromechanical actuator includes using the equation:

$$\frac{\partial}{\partial x}\left(\frac{1}{\rho_x}\frac{\partial\Phi}{\partial x}\right)+\frac{\partial}{\partial y}\left(\frac{1}{\rho_y}\frac{\partial\Phi}{\partial y}\right)=0$$

where, ρ=resistivity value, and Φ=electrical potential and the act of calculating the current density for each element of the microelectromechanical actuator includes using the equation:

$$J=\frac{1}{\rho}\nabla\Phi$$

where, J=current density, ρ=resistivity value, and ∇Φ is electrical potential gradient.

It is a fifteenth aspect of the present invention to provide a method of operating a microelectromechanical fluid ejector to eject a particular volume of fluid, the method comprising: (a) calculating a pulse width, to be applied to a microelectromechanical actuator to displace a predetermined volume droplet from a nozzle of a printing apparatus, taking into consideration Joule heating for each element of the microelectromechanical actuator, wherein a current density for each element of the microelectromechanical actuator is taken into consideration to determine the Joule heating; and (b) applying a pulse to the microelectromechanical actuator using the pulse width calculated to eject a droplet of fluid from a nozzle, where the droplet is within a predetermined volume range.

In a more detailed embodiment of the fifteenth aspect, the Joule heating is determined by acts including: (i) assigning a resistivity value to each element of the microelectromechanical actuator; and (ii) calculating a current through the microelectromechanical actuator, taking into consideration the current density for each element of the microelectromechanical actuator and the resistivity value of each element of the microelectromechanical actuator, where the Joule heating for each element of the microelectromechanical actuator is determined taking into consideration the current through the microelectromechanical actuator. In yet another more detailed embodiment, the act of determining current density includes calculating a nonuniform current density. In a further detailed embodiment, the act of determining current density includes the act of calculating the electric field in a microelectromechanical actuator using the equation:

$$\frac{\partial}{\partial x}\left(\frac{1}{\rho_x}\frac{\partial \Phi}{\partial x}\right)+\frac{\partial}{\partial y}\left(\frac{1}{\rho_y}\frac{\partial \Phi}{\partial y}\right)=0$$

where, ρ=resistivity value, and Φ=electrical potential and the act of calculating current density for each element of the microelectromechanical actuator includes using the equation:

$$J=\frac{1}{\rho}\nabla\Phi$$

where, J=current density, ρ=resistivity value, and ∇Φ is electrical potential gradient.

It is a sixteenth aspect of the present invention to provide a method of operating a microelectromechanical fluid ejector to eject a particular volume of fluid, the method comprising: (a) measuring, in-situ, the electrical resistance of a microelectromechanical fluid ejector; and (b) adjusting at least one of a voltage delivered to the microelectromechanical fluid ejector and a pulse width applied to the microelectromechanical fluid ejector to maintain joule heating of the microelectromechanical fluid ejector within a predetermined range.

It is a seventeenth aspect of the present invention to provide an apparatus adapted for use in selective deposition of a fluid onto a surface, the apparatus comprising a plurality of micromachined fluid ejectors arranged to operatively provide a vertical resolution of at least 300 dots per inch, where each micromachined fluid ejector comprises a first material having a first thermal expansion coefficient at least partially encased by a second material having a second thermal expansion coefficient, the first thermal expansion coefficient being greater than the second thermal expansion coefficient, and each micromachined fluid ejector having a length greater than a width and a height thereof, a cross section along the length of the adaptable beam comprising a first layer of the first material, a first layer of the second material, where a thickness of the first layer of the first material is greater than ten times a thickness of the second layer of the first material.

DETAILED DESCRIPTION

The exemplary embodiments of the present invention are described and illustrated below to encompass composite material microelectromechanical system (MEMS) actuators and associated methods of designing, fabricating, and operating such actuators. More specifically, the present invention may be used with a printing apparatus, such as a printer or multi-function device that is capable of printing, for selective deposition of a material onto a surface (as used herein, a surface can be that of a medium or substrate, for example, or a surface of a material, such as ink, which is on the surface of the medium/substrate). Of course, it will be apparent to those of ordinary skill in the art that the preferred embodiments discussed below are exemplary in nature and may be reconfigured without departing from the scope and spirit of the present invention. However, for clarity and precision, the exemplary embodiments as discussed below may include optional steps and/or features that one of ordinary skill will recognize as not being a requisite to fall within the scope of the present invention. In addition, for purposes of brevity, the following description may omit discussing topics known to those of ordinary skill, such as, without limitation, the finite element technique.

Figure 1:
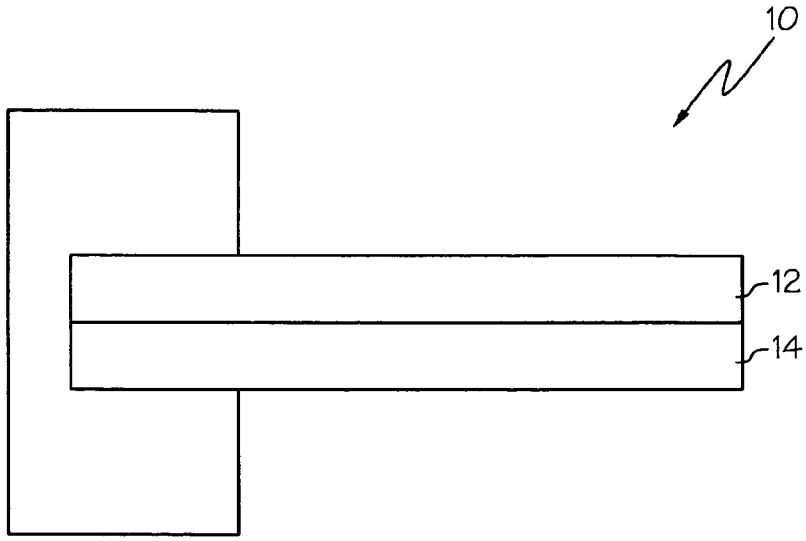
FIG. 1 (PRIOR ART)
FIG. 1 is perspective cross-sectional view of a prior art composite material actuator.

Referring to FIG. 1, composite material actuators 10 use a beam structure consisting of at least two different materials 12, 14. A first material layer 12, commonly referred to as an insulating layer, includes a thermal expansion coefficient substantially smaller than that of a second material layer 14, commonly referred to as a conductive layer. It is to be understood by one of ordinary skill that the conductive layer may perform functions analogous to those of an electrical resistor, however, the conductive layer will be a superior electrical conductor in comparison to the insulating layer. A recurring theme in prior art literature teaches that the optimum thickness ratio for a composite material actuator comprised of two materials 12, 14 is determined by the following relationship:

$$\frac{h_2}{h_1} = \sqrt{\frac{Y_1}{Y_2}} \quad \text{(Equation 1)}$$

where, $h_1$=thickness of the conductive layer 14

$h_2$=thickness of the insulator layer 12

$Y_1$=Young's modulus of the conductive layer 14

$Y_2$=Young's modulus of the insulator layer 12

In accordance with the present invention, however, it has been found that Equation 1 does not result in the optimum thickness ratio of the two materials 12, 14. To determine the optimum thickness ratio, more properties need to be considered than simply thickness and Young's modulus.

The coupled nature of the electric field, the temperature field, and the stress-displacement field is complex with respect to the operation of composite material actuators 10. To quantitatively evaluate a composite material actuator 10, material properties other than just Young's modulus should be considered. Among the material properties that may be considered are density, specific heat, thermal conductivity, Poisson's ratio, thermal expansion coefficient, and resistivity. Exemplary values for these material properties, along with Young's modulus, are provided for two exemplary materials, TiAl and $SiO_2$, in Table 1. Using these relevant material properties, along with the geometric parameters of the actuator structure, it will be shown that the optimum thickness for the insulating layer 12 of the composite actuator 10 is greater than the value predicted by Equation 1 and those values articulated in the prior art.

TABLE 1

| Material | $SiO_2$ | TiAl |
|---|---|---|
| Density (kg/m$^3$) | 2185 | 3636 |
| Specific heat (J/kg-K) | 744 | 727 |
| Thermal conductivity (W/m-K) | 1.4 | 11 |
| Young's modulus (GPa) | 70 | 188 |
| Poisson's ratio | 0.16 | 0.24 |
| Thermal expansion coefficient (K$^{-1}$) | $0.5 \times 10^{-6}$ | $15.5 \times 10^{-6}$ |
| Resistivity (Ω-cm) | ~$10^{17}$ | $160 \times 10^{-6}$ |

Figure 2:
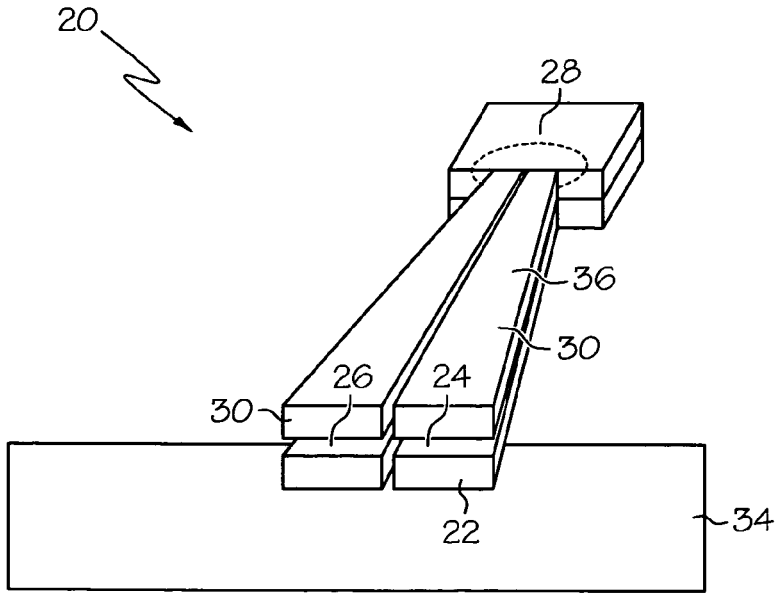
FIG. 2 is an elevated perspective view of a first exemplary MEMS actuator in accordance with the present invention.

Referencing FIG. 2, an exemplary actuator 20 in accordance with the present invention includes a TiAl conductive/resistor layer 22 having a cathode region 24 and an anode region is 26. It has been reported that current crowding occurs in the vicinity of a bend in an electrical conduction path as observed by P. M. Hall, *Resistance Calculations for Thin Film Patterns*, Thin Solid Films, 1, 1967, p 277-295 and M. Horowitz, R. W. Dutton, *Resistance Extraction from Mask Layout Data*, IEEE Transactions on Computer-Aided Design, Vol CAD-2, No. 3, July 1983, the disclosures of which are hereby incorporated by reference. As shown in FIG. 2, the electrical conduction path in the TiAl layer 22 makes a sharp U-turn in the vicinity of the beam tip. To reduce current crowding in the vicinity of this U-turn, a bridge 28, fabricated from aluminum in this exemplary embodiment, connects the anode 26 and cathode 24 regions approximate the beam tip. The bridge 28 acts as a shorting bar in the vicinity of the U-turn to reduce current crowding and excessive current density in the TiAl layer 22.

The actuator 10 may also include a dielectric/insulating layer 30 adjoining the resistor layer 22 comprising, such as, without limitation, $SiO_2$. The exemplary TiAl layer 22 is referred to as a resistor layer at least in part because it is electrically resistive compared to common conductors like aluminum, copper, and gold. The exemplary TiAl layer 22 is also referred to as a conductor layer, however, because compared to the $SiO_2$ layer 30, it is electrically conductive. The insulating layer 30 provides a number of functions such as, without limitation, providing thermal insulation to the resistor layer 22 and providing a substrate for directing movement of the resistor layer 22 during expansion or contraction of the layer 22. The insulating layer 30 may also protect the resistor layer 22 from ink corrosion when submerged in an ink reservoir during printing operations.

In a further detailed exemplary embodiment, the actuator 20 may also include a second dielectric layer (not shown) acting with the insulating layer 30 to sandwich the resistor layer 22 there between, where the dual dielectric layers comprise a passivation layer.

While FIG. 2 depicts a tapered beam, it is within the scope and spirit of the present invention to utilize beams of various constructions and dimensions, such as, without limitation, beams that are generally rectangular or beams that have an hourglass shape.

The insulating layer 30 may comprise any material having a thermal expansion coefficient less than that of the resistor layer 22. As explained earlier, the insulating layer may also be electrically resistive to prevent current flow through it, as well as thermally insulative. During operation of the actuator 20, the resistor layer 22 may actually exhibit increases in thermal energy sufficient to generate vapor bubbles from the surrounding liquid media but for the presence of the insulating layer 30. As will be discussed below, a predetermined thickness range of the insulating layer 30 will inhibit the top beam surface 36 from reaching a temperature sufficient to facilitate the formation of vapor bubbles on the nozzle side of the actuator 20. With the exception of diamond, materials that are electrically insulating are also thermally insulating. Exemplary materials for use as the insulating layer 30 include, without limitation, $SiO_2$. Exemplary materials for use as the resistor layer 22 include, without limitation, metals and metal alloys such as TiAl. One or both of the resistor layer 22 and the insulating layer 30 may be mounted to a substrate 34 such as, without limitation, the silicon substrate of an inkjet printhead. The substrate 34 provides an anchor about which the actuator 20 is adapted to oscillate from expansion and contraction of the resistor layer 22.

Figure 3:
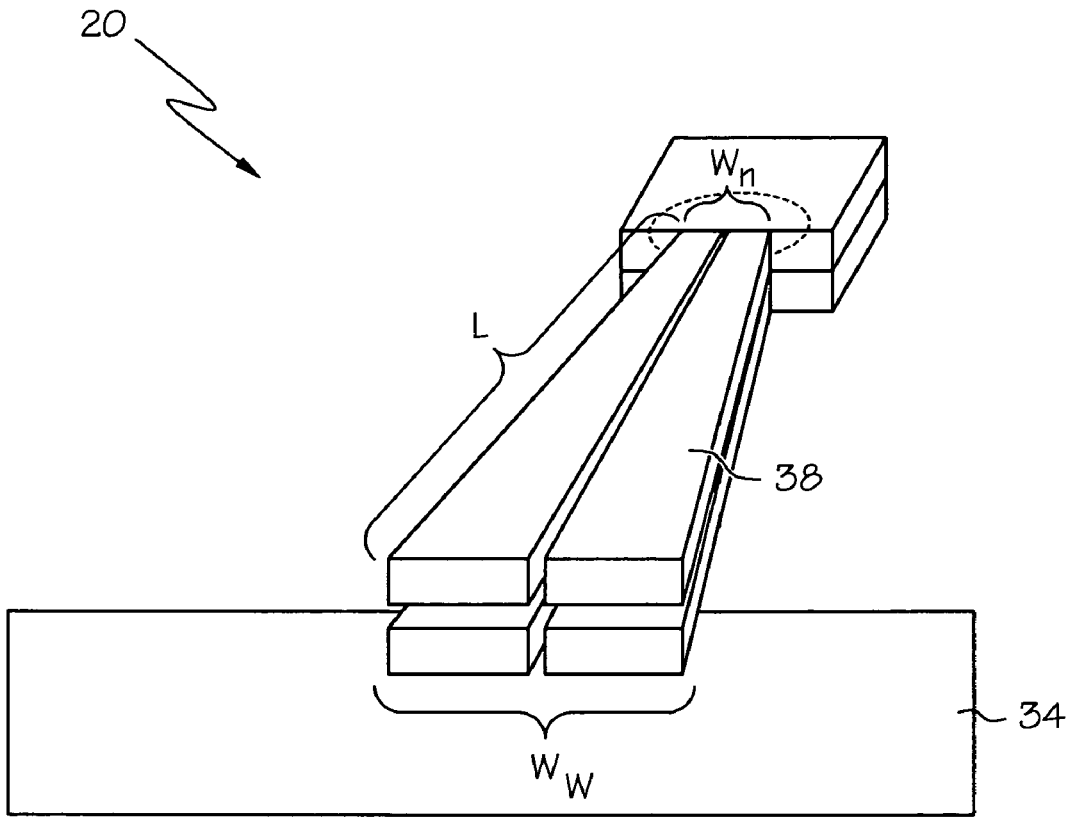
FIG. 3 is an elevated perspective view of the MEMS actuator of FIG. 2.

Referencing FIG. 3, the exemplary actuator 20 includes a beam structure 38 having a length L and a wider width Ww approximate the substrate 34 and a narrower width Wn approximate an opposing end of the actuator 20. An exemplary length L for the beam structure 38 of the present invention may be approximately 100 microns. Exemplary wider widths Ww include approximately 30 microns and exemplary narrower widths Wn include 10 microns. As discussed above, the actuator may embody other arrangements or dimensions other than the tapered beam embodiment, such as, without limitation, a rectangular beam embodiment 21 (See FIG. 5*b*) that includes an exemplary length of 100 microns and an exemplary width of 20 microns.

Figure 4:
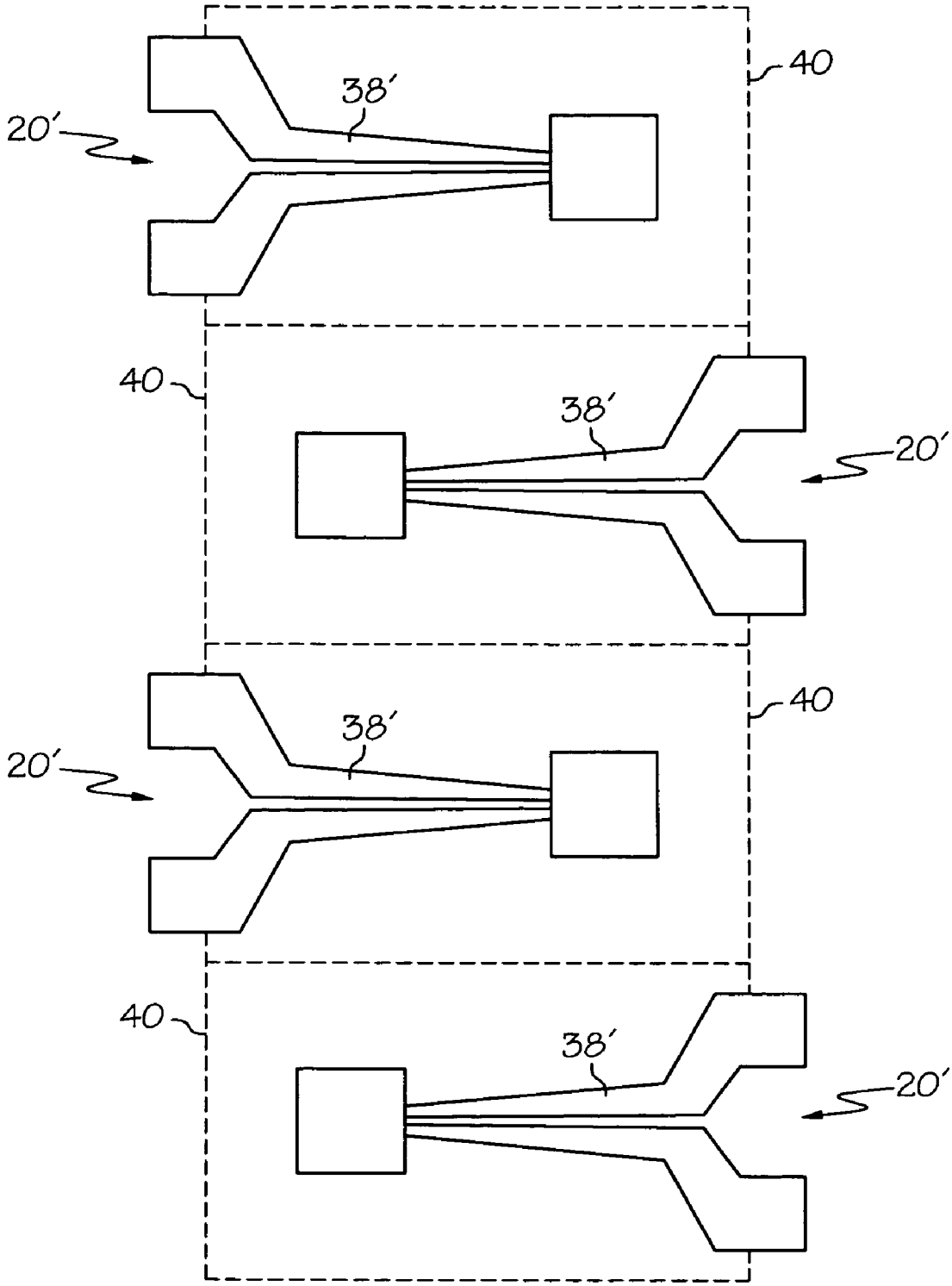
FIG. 4 is an overhead view of an exemplary array of MEMS actuators in accordance with the present invention.

As shown in FIG. 4, an exemplary array of actuators 20' may be arranged on a printhead to provide a predetermined dots per inch (dpi) per swath. The dotted lines of FIG. 4 represent exemplary fluid reservoir boundaries 40 within which the beams 38' of the actuators 20' operate. It is also within the scope of the invention for the actuators 20' to be arranged to share a common fluid reservoir and that the actuators be operated to vary the droplet volume through a nozzle of a printer. The exemplary array of actuators 20' is interlaced to provide approximately 300 dpi.

The exemplary actuators 20, 20', 21 of the present invention utilize Joule heating, which is a function of the square of current density. The electric field resulting from the current density along the length of the beam structure 38, 38' appears to obey Equation 2, which can be solved using the finite element technique known to those of ordinary skill.

$$\frac{\partial}{\partial x}\left(\frac{1}{\rho_x}\frac{\partial\Phi}{\partial x}\right)+\frac{\partial}{\partial y}\left(\frac{1}{\rho_y}\frac{\partial\Phi}{\partial y}\right)=0 \qquad \text{(Equation 2)}$$

where,

ρ=resistivity value

Φ=electrical potential

The 2D domain of the beam structure 38, 38' is meshed in (x,y) coordinates. The thickness of each element the beam structure 38, 38' is then assigned as a function of material thickness (z). This process results in a description of each finite element of the beam structure 38, 38' in three dimensions. Each element of the beam structure 38, 38' is also assigned a resistivity value (ρ). The electrical potential (Φ) is set equal to 1 at the anode and 0 at the cathode so that Equation 2 can be solved for Φ(x,y) at every node in the domain. Knowing Φ(x,y) permits computation of Grad(Φ). Grad(Φ) then leads to current density (J) in each element of the beam structure 38, 38' as set forth in:

$$J=\frac{1}{\rho}\nabla\Phi \qquad \text{(Equation 3)}$$

Note:

$$\nabla\Phi=Grad(\Phi)=\frac{\partial\Phi}{\partial x}+\frac{\partial\Phi}{\partial y}$$

Integrating the current density (J) over the anode cross-section produces the current (i) through the resistor layer 22 when 1 volt is applied between the anode 26 and the cathode 24. Heater resistance (R) may also be thereafter directly computed. The resistor layer 22 squares (Sq) is then computed from the sheet resistance (Rsheet):

$$R=\frac{V_{Anode}-V_{Cathode}}{i}=\frac{1}{i} \qquad \text{(Equation 4)}$$

$$Sq=\frac{R}{(\rho/thk)}=\frac{R}{R_{Sheet}}$$

where,

ρ=resistivity value thk=thickness of the resistor layer 22

R=heater resistance

It is to be understood that utilizing Equation 4 is not required to practice all aspects of the present invention. More specifically, Equation 4 may be important for electrical circuit engineers in designing drive circuitry and power supplies for a MEMS actuator to know the heater resistance (R) and squares (Sq) of the beam structure 38, 38'.

Figure 5A:
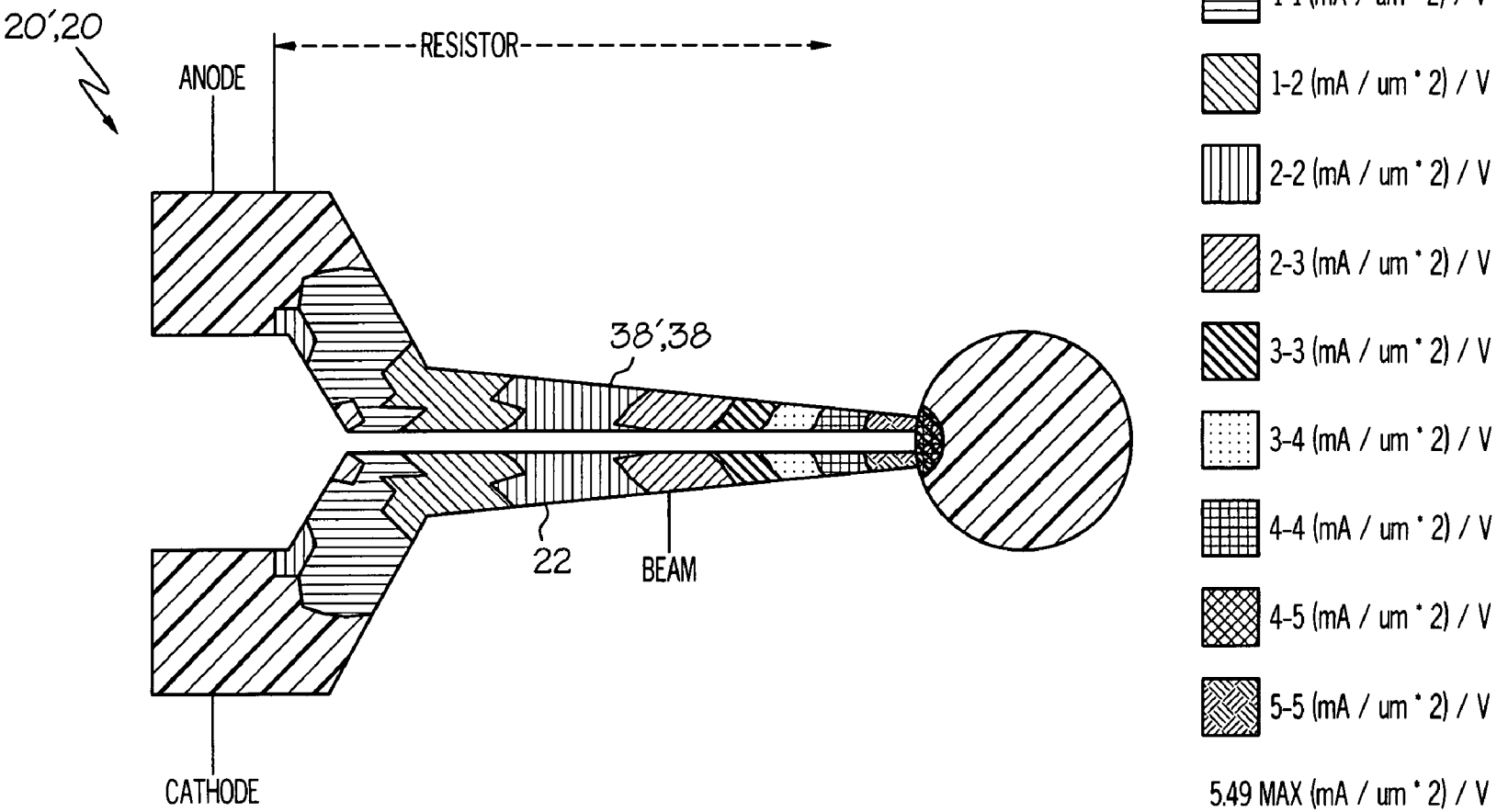
FIGS. 5*a* and 5*b* are overhead views showing current density of exemplary MEMS actuators in accordance with the present invention.
Figure 6A:
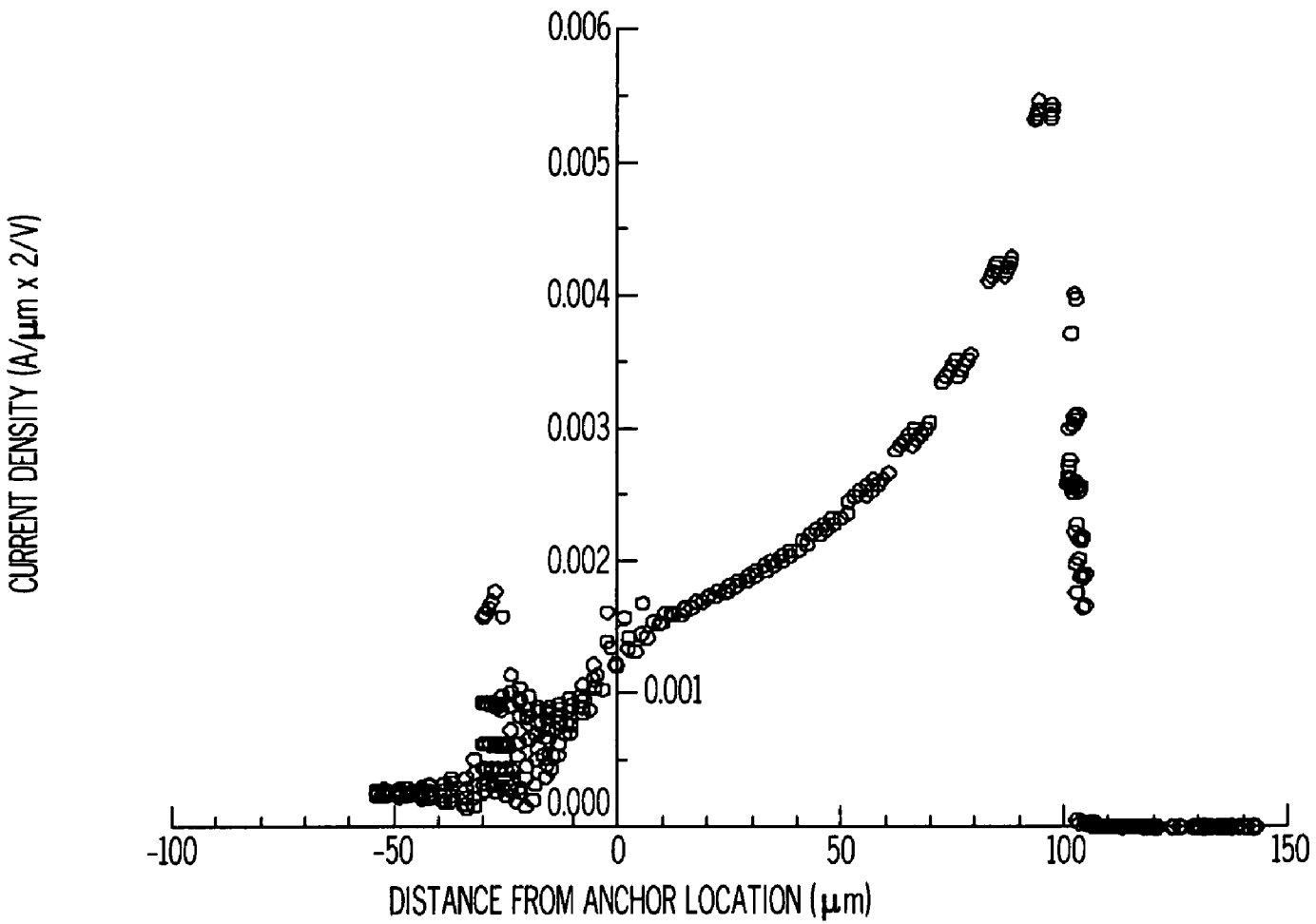
FIGS. 6*a* and 6*b* are plots showing current density of the exemplary MEMS actuators of FIGS. 5*a* and 5*b*, respectively, in relation to position from an anchor point of the actuator.

FIGS. 5*a* and 6*a* illustrate the solutions of Equations 2 and 3 for the tapered beam embodiment 20, 20'. Recall that the solution of the differential Equation 2 applied 1 volt at the anode and 0 volts at the cathode. Therefore, if the resistor had 10 volts applied between the anode and cathode, the actual current density values would be obtained by multiplying the plotted values by a factor of 10. FIGS. 5*a* and 6*a* both indicate that as the tapered beam 38, 38' cross section reduces linearly, the current density increases nonlinearly. As will be discussed below, this nonlinear current density effect will result in nonuniform heating.

Figure 5B:
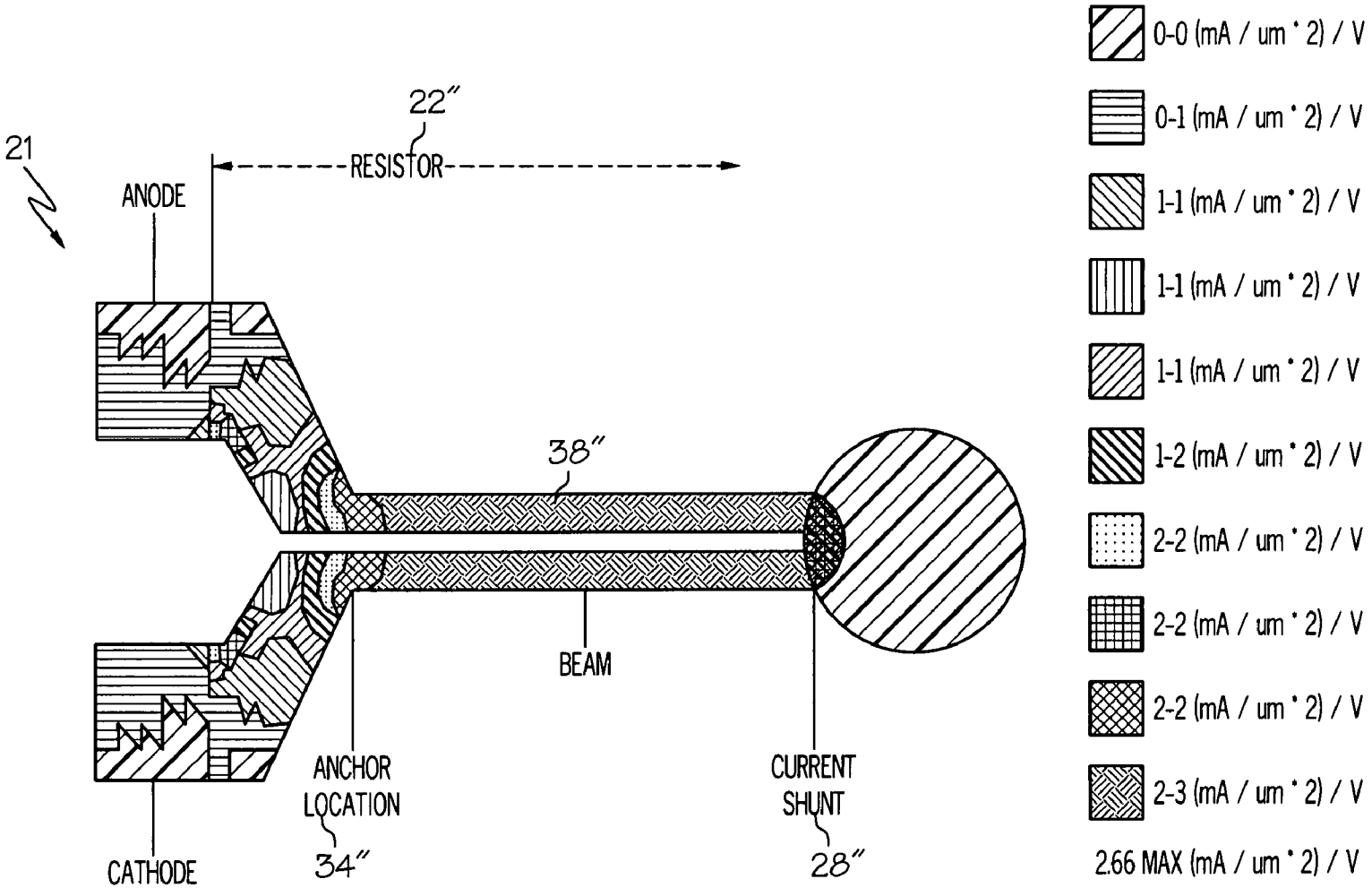
Figure 6B:
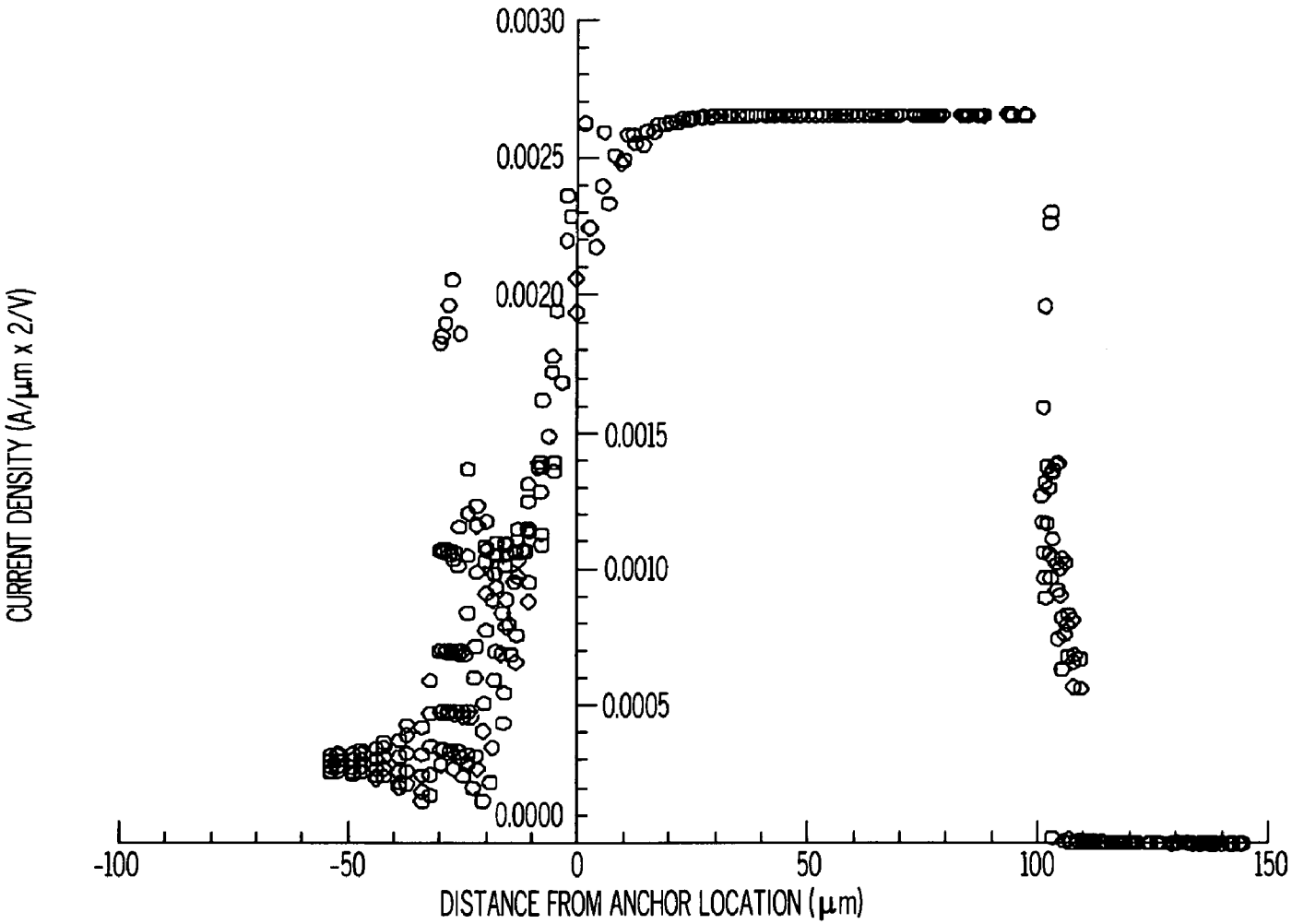

FIGS. 5*b* and 6*b* illustrate the current density distribution in the rectangular beam embodiment 21. Note that in contrast to the tapered beam embodiment 20, 20', the current density is uniform in the rectangular beam embodiment 21 in the region between the anchor location 34" and the current coupling device 28". As will be discussed below, this uniform current density distribution will result in uniform heating.

After the current density distribution is known for the beam structure 38, 38', 38" the transient temperature field T(x,y,t) may be computed. Because the form of Equation 5 is similar to Equation 2, the same numerical methods, including utilization of the finite element technique, may be used to compute the temperature field and the electric field for the beam structure 38, 38', 38" as follows:

$$\frac{\partial}{\partial x}\left(k_x\frac{\partial T}{\partial x}\right)+\frac{\partial}{\partial y}\left(k_y\frac{\partial T}{\partial y}\right)+Q=\lambda\frac{\partial T}{\partial t} \qquad \text{(Equation 5)}$$

where,

T=temperature $k=k_x=k_y$=thermal conductivity

Q=Joule heating term

λ=(density×specific heat)

t=time

To utilize the finite element method, the beam domain is divided into a mesh of interconnected nodes and elements. Joule heating for each finite element of the beam structure 38, 38', 38" may be computed as follows:

$$q^{(e)}=(V_{1\text{-}2}J^{(e)})^2\mathrm{Vol}^{(e)}\rho^{(e)} \qquad \text{(Equation 6)}$$

where, $q^{(e)}$=power dissipated in element (e) (Watts)

$V_{1\text{-}2}$=voltage across the anode-cathode (Volts)

$J^{(e)}$=current density/volt in element (e) (Amperes/$\mu m^2$/Volt)

$\mathrm{Vol}^{(e)}$=volume of element (e) ($\mu m^3$)

$\rho^{(e)}$=resistivity of element (e) (Ohm-μm)

In each of the following heat transfer calculations, the domain of the beam structure 38, 38', 38" is meshed so that a fluid, such as ink, surrounds the entire deflected region of the exemplary embodiment 20, 20', 21, while the aspect of the beam structure 38, 38', 38" not appreciably deflected is mounted to the substrate 34, 34", such as silicon.

Figure 13:
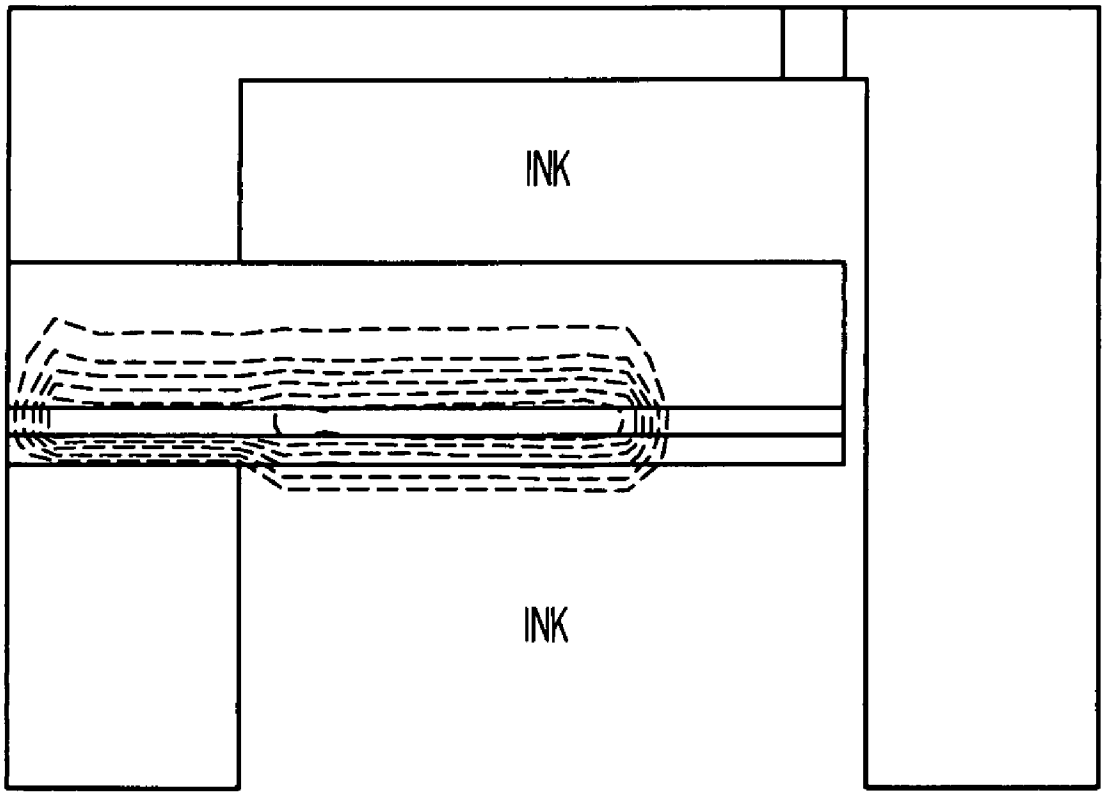
FIG. 13 is a plot in accordance with the present invention showing a temperature contour map of the beam actuator, its support structure and the surrounding fluid.
Figure 14:
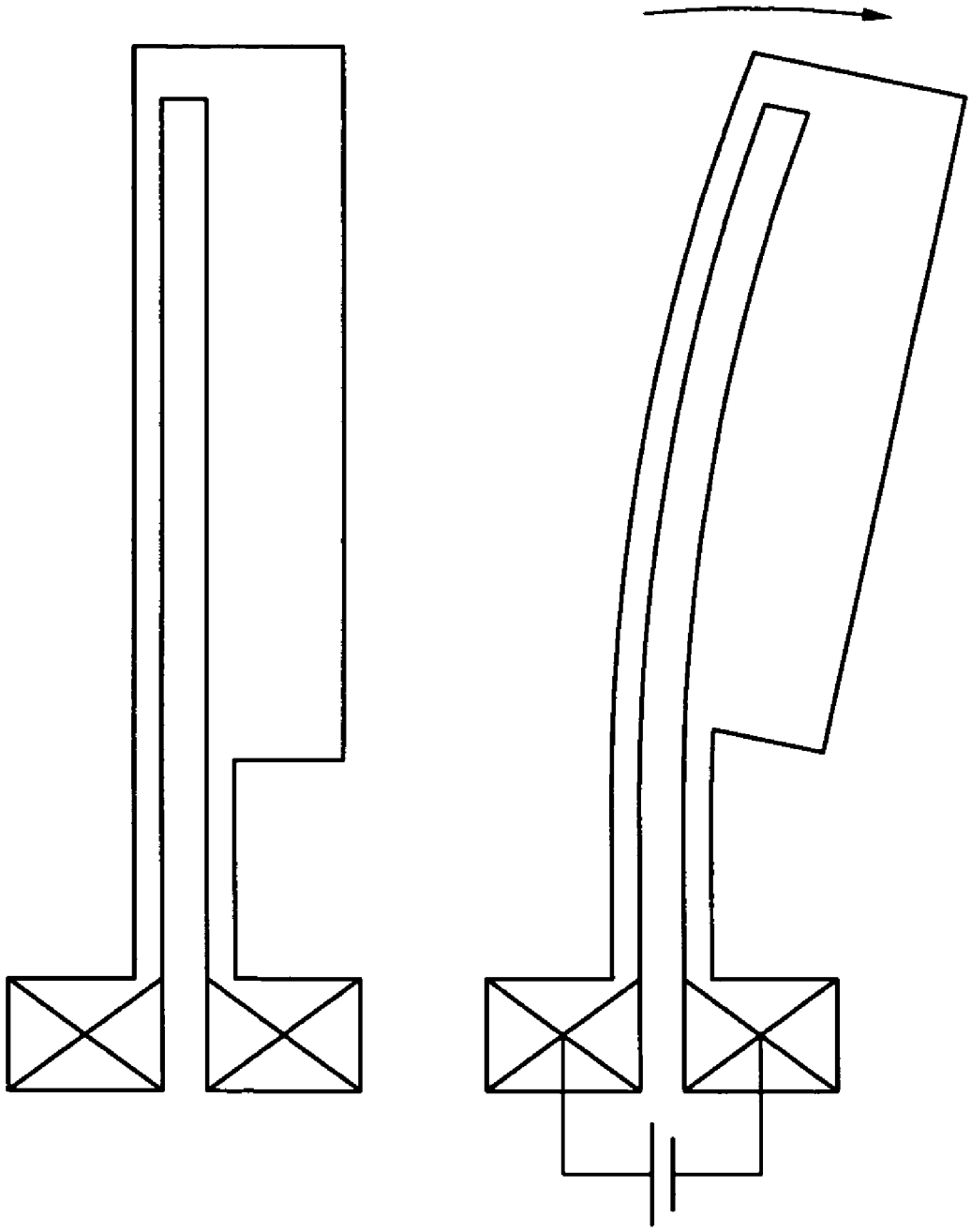
FIG. 14 (PRIOR ART)
FIG. 14 is a side view of a prior art Guckel actuator in its default position and in its displaced position.

The exemplary rectangular beam embodiment 21 has a calculated resistance of 60.2 Ohms. The resistor layer 22" in this exemplary embodiment is approximately 0.8 microns thick, and the insulator layer (not shown) is approximately 4.0 microns thick. Using an exemplary pulse time of 2 microseconds, an exemplary voltage of 7 volts, and the current density distribution as shown in FIGS. 5*b* and 6*b*, Equation 6 can be solved for the joule heating power in each finite element ($q^{(e)}$). These numerical values are utilized in the finite element mesh approximating Equation 5 to determine the entire domain of the temperature field. The finite element solution of Equation 5 indicates that this exemplary pulse condition results in a temperature rise of 150° C. in resistor layer 22" of the rectangular beam embodiment 21. Integration of ($q^{(e)}$) over all of the finite elements in resistor layer 22" during the exemplary pulse time indicates that 1.63 microjoules is consumed. In other words, the pulse of electric current consumed 1.63 microjoules in 2 microseconds to raise the median temperature of resistor layer 22" in the exemplary embodiment 21 by 150° C. However, it is helpful to know the temperature field of the entire beam structure 38" to calculate the mechanical deflection, which may be accomplished using Equation 5. FIG. 13 is an exemplary temperature field solution of Equation 5 resulting from the finite element method.

The exemplary 1.63 microjoule pulse applied to the exemplary rectangular embodiment 21 results in a differential thermal expansion between the insulating layer ($SiO_2$) and the resistor layer (TiAl) 22". The net result of this thermal expansion is a beam structure 38" deflection of about 1 micron perpendicular to the length L. When implemented within an ink reservoir, the actuator 21 is theoretically capable of displacing a swept volume of about 1.9 picoliters when driven at 7 volts for 2 microseconds based in part upon the three dimensional features that may be used to calculate three dimensional displacement. Therefore, one possible method to vary the deflection of the beam structure 38" includes varying the pulse duration and/or varying the voltage, where an increase in pulse time generally provides an increase in deflection.

Figure 7A:
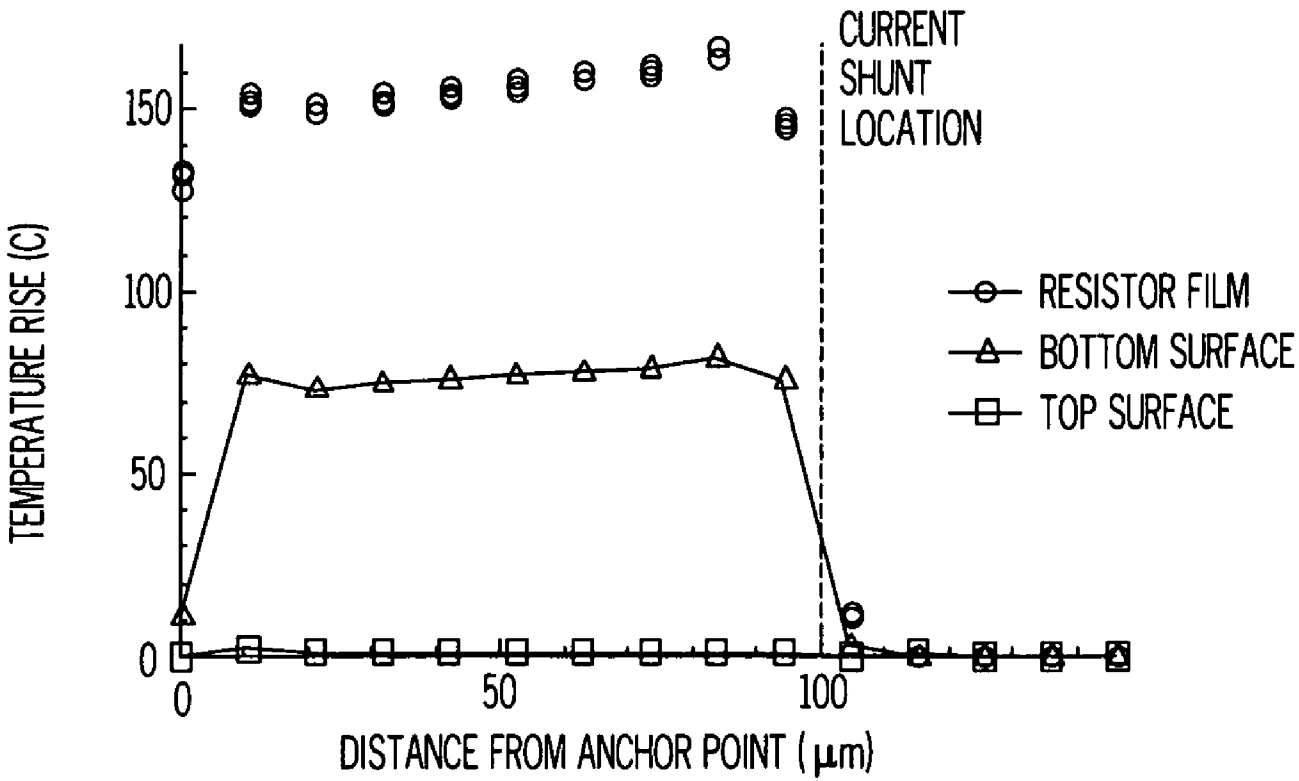
FIGS. 7*a* and 7*b* are plots showing temperature profiles of exemplary layers of the exemplary MEMS actuators of FIGS. 5*a* and 5*b*, respectively.
Figure 8A:
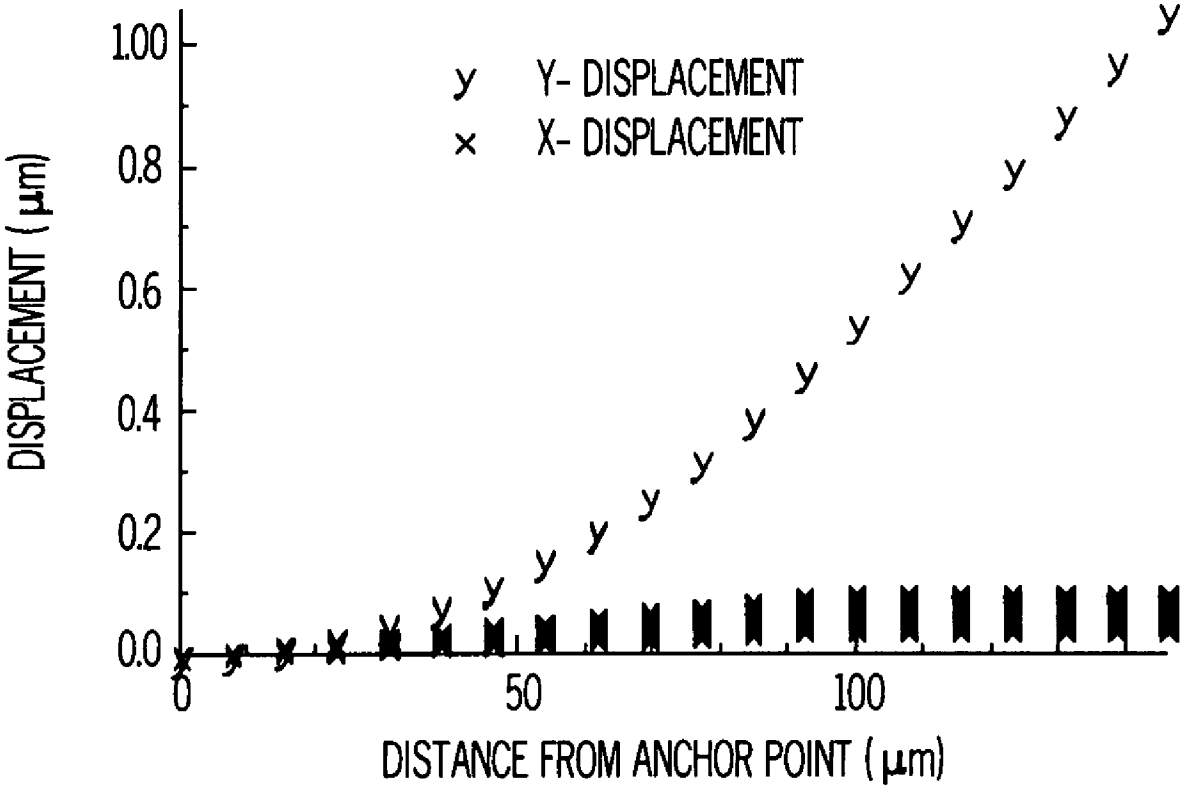
FIGS. 8*a* and 8*b* are plots showing displacement of a resistor layer and an insulating layer of the exemplary MEMS actuators of FIGS. 5*a* and 5*b*, respectively, in relation to position from an anchor point of the actuator.

FIGS. 7*a* and 8*a* are graphs plotting temperature rise of the above exemplary rectangular beam embodiment 21 in relation to distance from where the beam 38" is anchored to the substrate 34", as well as displacement of the beam 38" of the exemplary embodiment 21 in relation to distance from where the beam 38" is anchored to the substrate 34". These data points were developed with the exemplary rectangular embodiment 21 being driven with 7.0 volts for 2 microseconds. The beam 38" includes generally three components that are plotted in each graph and include the thicker insulating layer, the resistor layer 22", and a thinner insulating layer, where the resistor layer 22" interposes the insulating layers.

Similarly, the finite element technique was used for the tapered beam embodiment 20, 20'. The tapered beam embodiment 20, 20' may be presumed to have the same surface area and length L as the rectangular beam embodiment 21, except that Ww is 30 microns and Wn is 10 microns. The sequential solutions of Equations 2, 3, and 4 indicate that the tapered beam embodiment 20, 20' has a resistance of approximately 67.6 Ohms. FIGS. 5*a* and 6*a* illustrate the current density distribution of the tapered beam embodiment 20, 20'. To maintain the same 1.63 microjoules of energy in a 2 microsecond pulse time, as a result of the tapered beam 38, 38' having a slightly higher resistance than the rectangular beam 38", the voltage applied to the tapered resistor was increased from 7 volts to 7.42 volts.

Figure 7B:
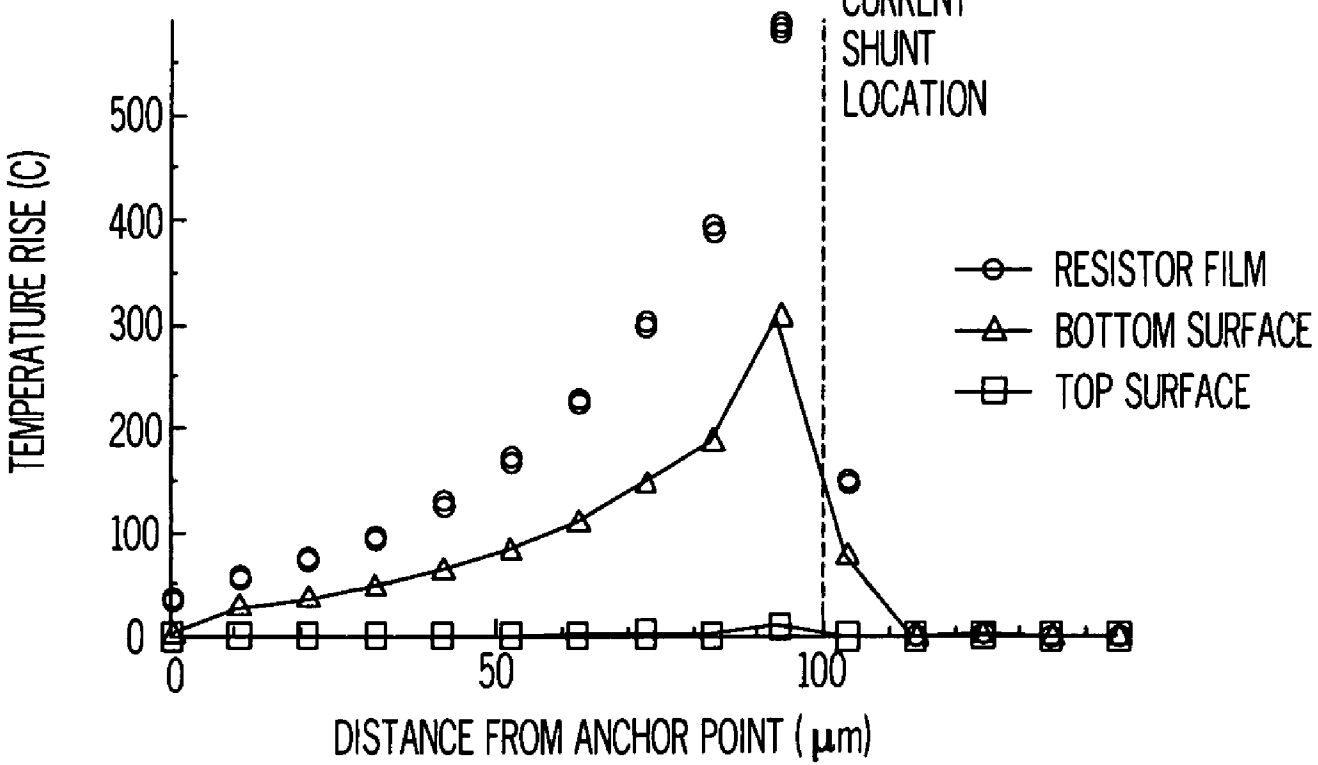
Figure 8B:
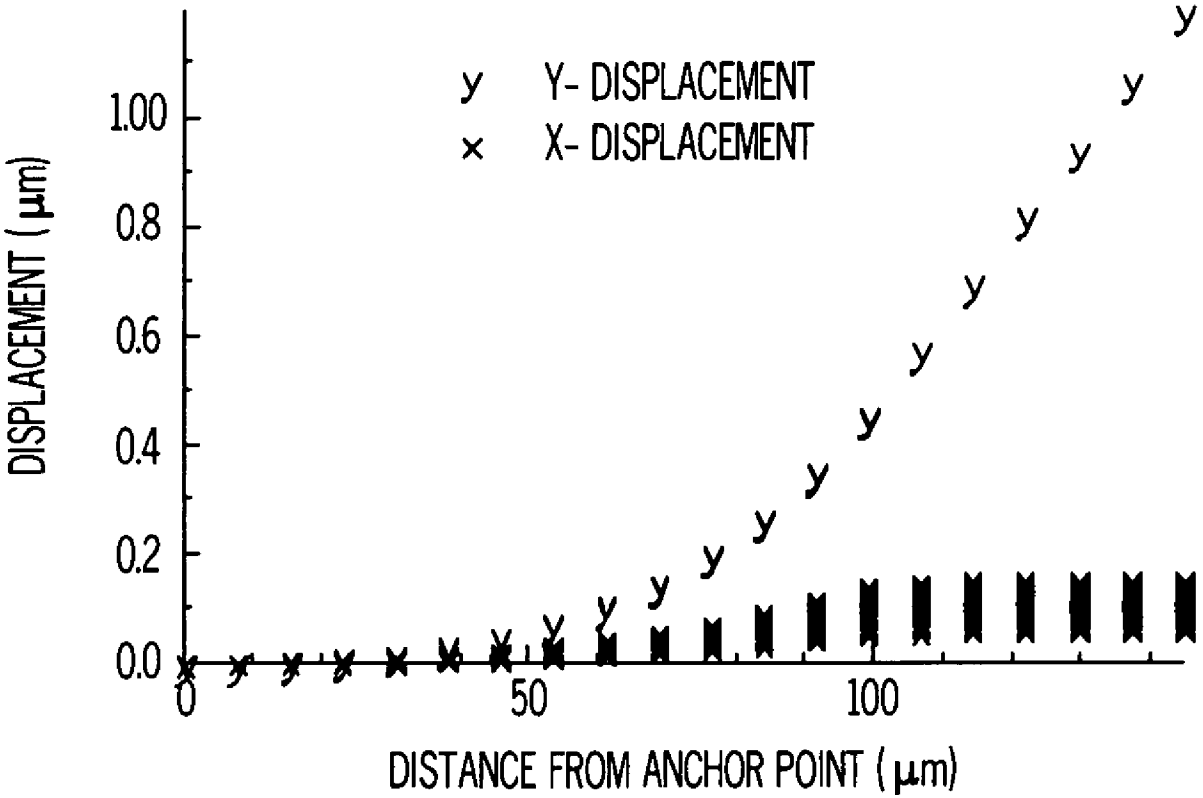

FIG. 7*b* is a plot showing the temperature in the tapered beam resistor layer 22, as well as the temperature on the top surface (nozzle side) and bottom surface (reservoir side) of the insulating layer, while FIG. 8*b* is a plot showing the beam 38, 38' displacement. Note that because the tapered beam embodiment 20, 20' generates higher temperatures approximate the beam tip, the tapered beam embodiment 20, 20' produces higher tip deflection than the rectangular beam embodiment 21 having the same length and surface area. Thus, the tapered beam embodiment 20, 20' produces 12% more (1.19 microns vs. 1.06 microns) tip deflection than the rectangular beam embodiment 21.

It is also within the scope of the present invention to monitor the pattern to be printed onto a substrate to discern if variable volume droplets of fluid may be advantageous. Those of ordinary skill are familiar with the techniques for evaluating and monitoring for boundaries within a string of digital printing instructions. In exemplary form, in instances where boundaries are to arise between separate colors or simply between bare aspects of the substrate and those aspects of the substrate that will have fluid deposited thereon, the present invention makes use of these boundary conditions to vary the volume of droplets ejected from a nozzle of a printer by utilizing smaller volume droplets of fluid in proximity to the boundary to lessen distortion and maintain sharp boundaries. One exemplary manner of carrying out this aspect of the present invention is to vary the voltage and/or the pulse supplied to the actuator 20, 20', 21 to provide differing displacements resulting in differing volume droplets. However, those of ordinary skill will readily be aware of additional techniques and methods for carrying out this aspect of the present invention given the teachings provided herein.

Figure 9:
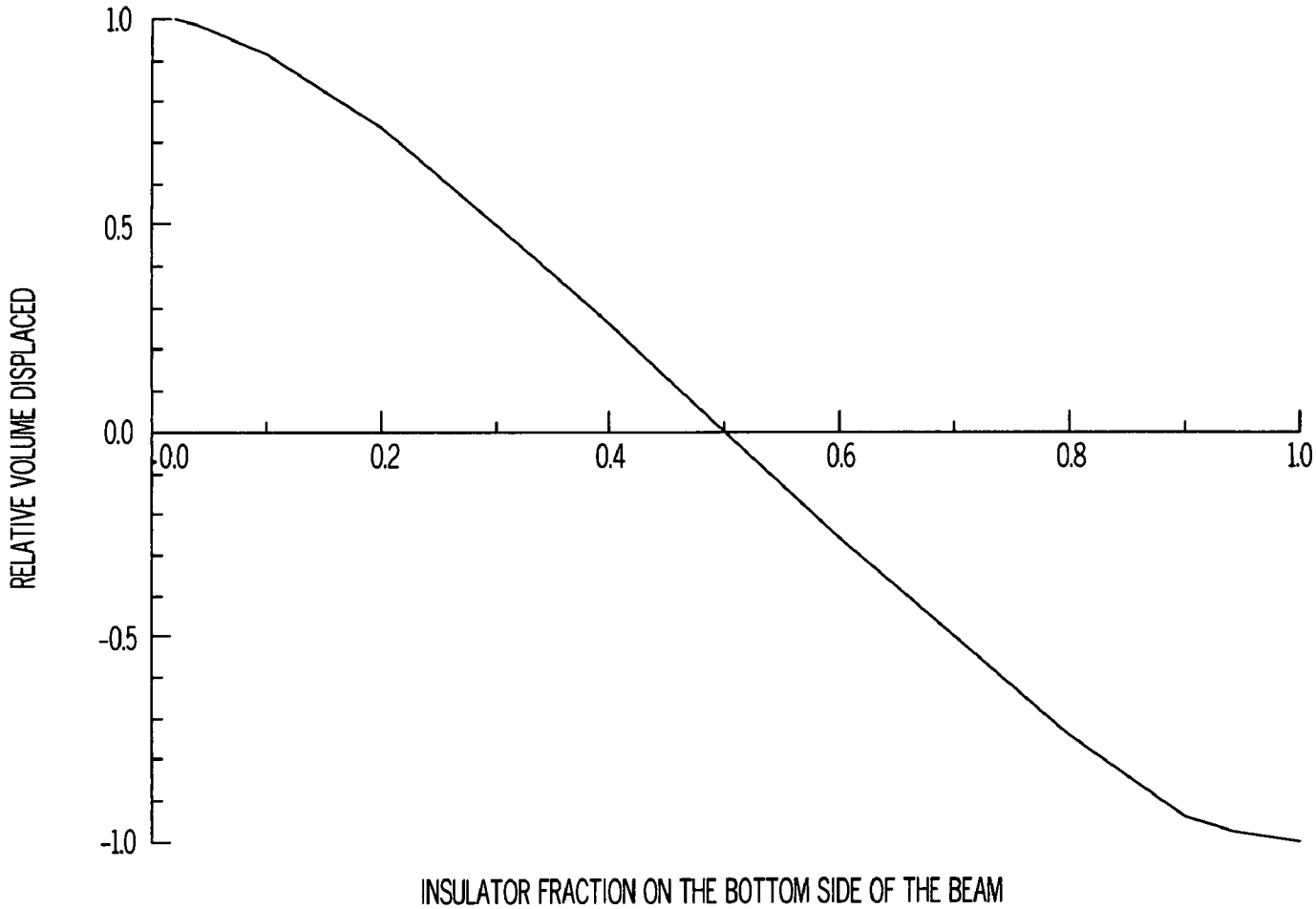
FIG. 9 is a plot showing relative volumes displaced by an exemplary MEMS actuator in accordance with the present invention as a function of passivation layer thickness.

Referencing FIG. 9, if insulating material is present on both sides of the resistor layer 22, 22", the resistor will deflect toward the thicker insulating material layer and the opposite thinner insulating material will act to retard deflection of the beam 38, 38', 38" toward the thicker insulating layer (;i.e. toward the nozzle). Therefore, in order to maximize beam 38, 38', 38" deflection/movement, no insulating material would be positioned opposite the thicker insulating layer 30. However, as discussed above, an insulating layer opposite the thicker insulating layer 30 may provide benefits such as, without limitation, protecting the resistor layer 22, 22" from ink corrosion, providing thermal insulation to the resistor layer 22, 22", and providing a substrate for directing movement of the resistor layer 22, 22" during expansion or contraction of the layer 22, 22", which merit consideration.

As one might expect, when the insulating layer is evenly split between the top and the bottom layers, there is no appreciable beam 38, 38', 38" or resistor layer 22, 22" deflection. When one side of the insulating sandwich includes insulating material with a greater thickness than the opposite side (i.e., more than 50% of the total insulator thickness), the beam 38, 38', 38" or resistor layer 22, 22" displacement is toward the insulating material with the greater thickness, presuming that the insulating material forming each layer embodies the same material properties of thermal expansion. The degree of beam 38, 38', 38" or resistor layer 22, 22" displacement continues to increase between 50-100 percent, with the maximum displacement of the beam occurring when only one insulating layer is present; i.e., no insulation sandwich.

Figure 10A:
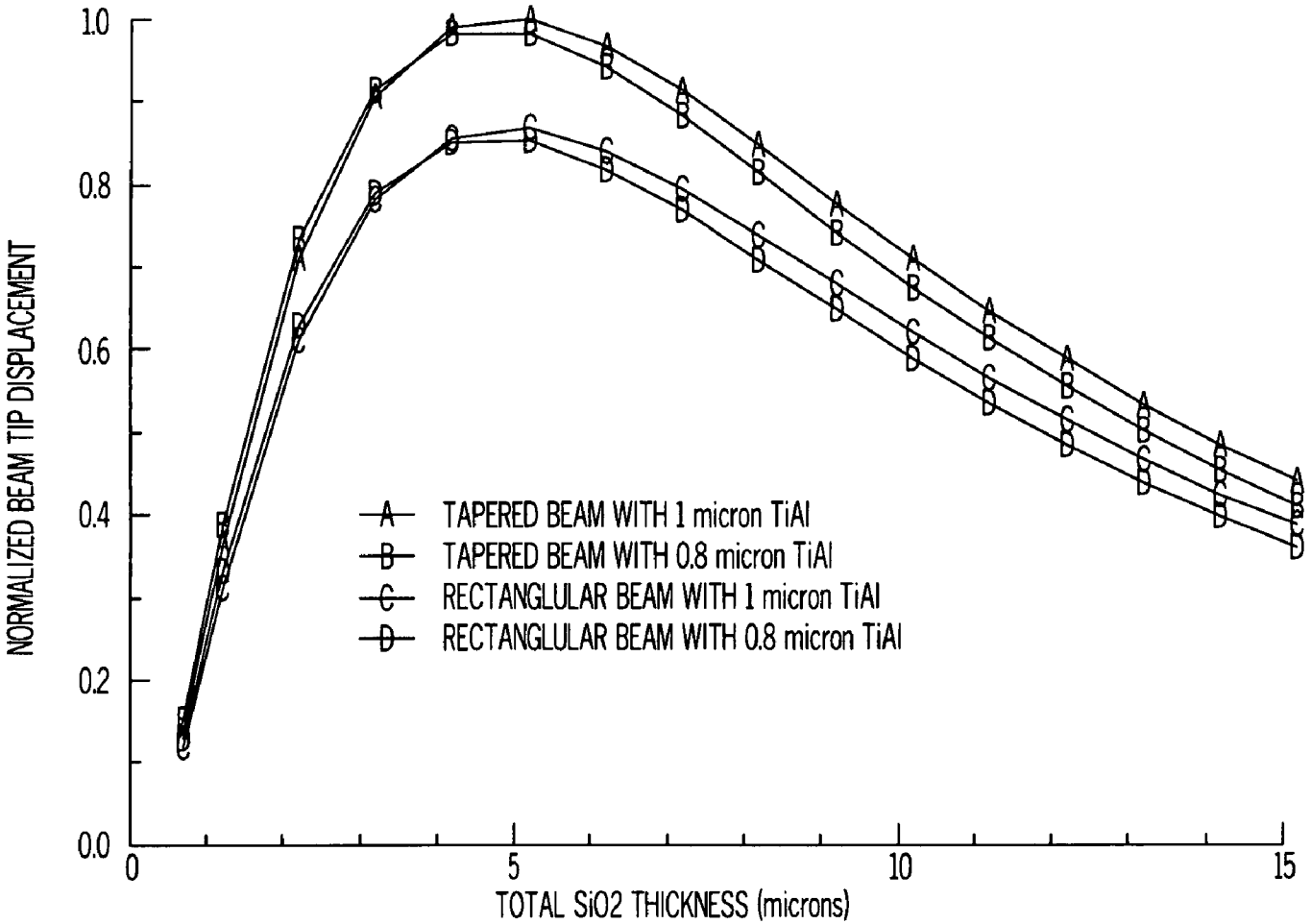
FIG. 10*a* is a plot showing beam tip displacement for a plurality of exemplary MEMS actuators in accordance with the present invention as a function of passivation layer thickness and resistor layer thickness.

Referencing FIG. 10*a*, two rectangular beam actuators 21 as well as two tapered beam actuators 20, 20'each having exemplary resistor layer 22, 22" thickness of about 0.8 μm and about 1.0 μm, respectively. As evidenced in FIG. 10*a*, the beam tip displacement is greatest for the tapered beam actuator 20, 20'. In addition, it can be observed that the optimum thickness of the $SiO_2$ layer is approximately 4-5 microns for both the tapered actuator 20, 20' and the rectangular actuator 21 having resistor layers of 0.8 and 1.0 microns, respectively. This finding clearly refutes the teachings of the prior art using only Equation 1. Furthermore, by apportioning the $SiO_2$ in accordance with FIG. 9, it is apparent that the $SiO_2$ thickness should be strongly biased toward the nozzle side of the beam. It will be apparent to those of ordinary skill that functional actuators may be fabricated using insulating layers of $SiO_2$ that are thinner and thicker than the 4-5 micron range.

Figure 10B:
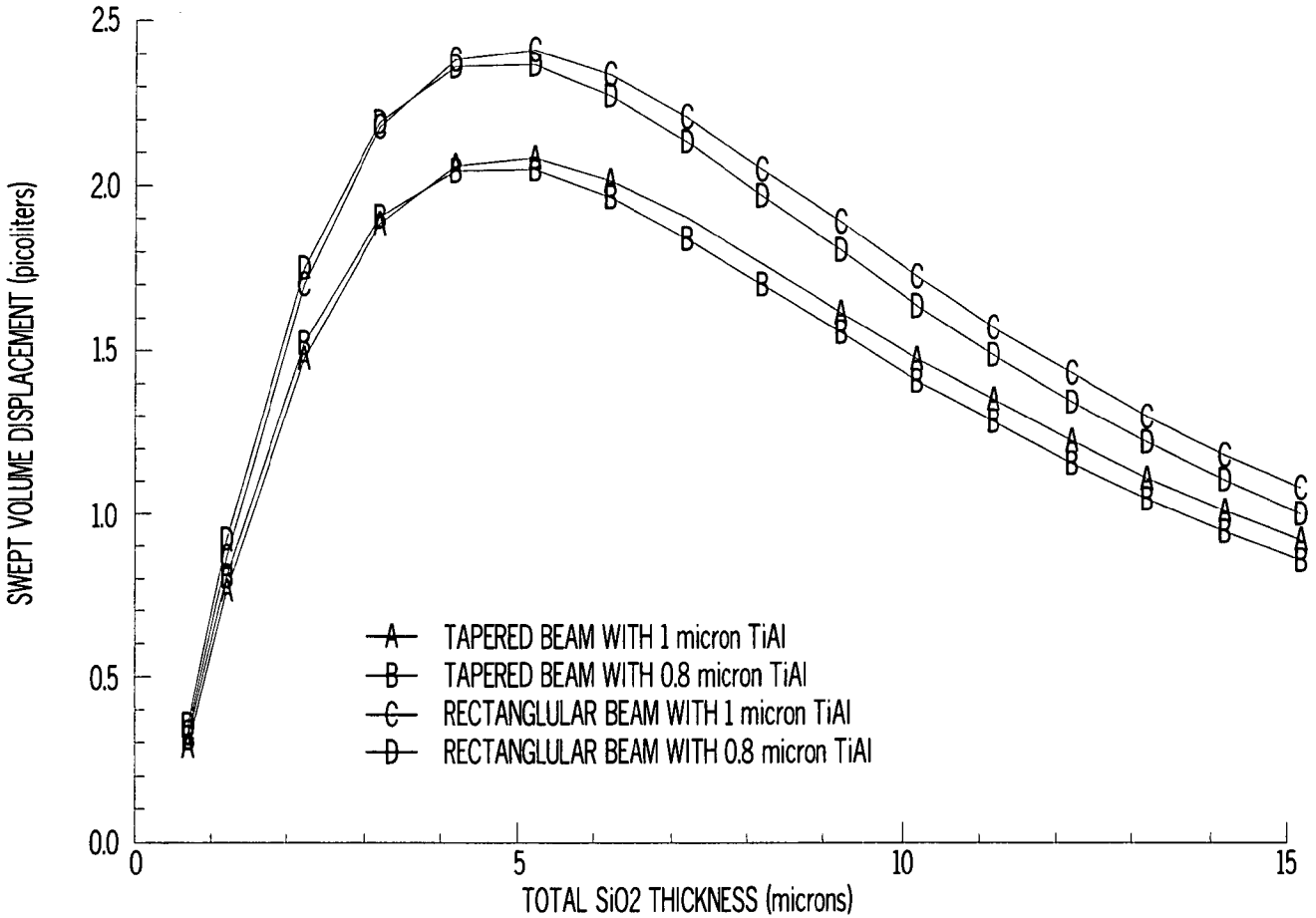
FIG. 10*b* is a plot showing swept volume displacement for a plurality of exemplary MEMS actuators in accordance with the present invention as a function of passivation layer thickness and resistor layer thickness.

Referring to FIG. 10*b*, the swept volume displacement for both the rectangular actuator 21 and the tapered actuator 20, 20' varies with respect to insulating layer 30 thickness. Consistent with FIG. 10*a*, the $SiO_2$ layer 30 is permitted to vary from about 0.7 to about 15 microns, and the TiAl layer 22, 22' is either 1.0 or 0.8 microns thick. Evident from the plot is that a thickness of 4-5 microns provides the optimum or maximum displacement of the actuator 20, 20', 21. As discussed above, it is within the scope of the invention to fabricate actuators that are not optimized for tip displacement or swept volume, and in exemplary form includes insulating layers 30 of $SiO_2$ between 2-3 microns.

Each of the exemplary embodiments 20, 20', 21 plotted in FIG. 10*a* have been driven with 1.63 microjoules. Thus, a 4-5 micron thick $SiO_2$ layer 30 permits a pumping effectiveness of about 1.5 picoliters per microjoule with the rectangular embodiment 21 and about 1.3 picoliters per microjoule with the tapered embodiment 20, 20'. These values represent a significant improvement in pumping effectiveness over prior art MEMS actuators that utilized a 2 micron thick $SiO_2$ layer 30 on the nozzle side of the resistor layer 22 and a 0.2 micron thick $SiO_2$ layer 30 opposite the nozzle side of the resistor layer 22.

As previously discussed, the exemplary embodiments of the present invention 20, 20', 21 are adapted to displace a fluid by thermally induced beam deflections. This is significantly different than prior art techniques that utilized a phase change of a portion of the fluid, explosive boiling, to facilitate displacement of another portion of the fluid. Therefore, to more precisely control the volumetric flow of fluid displaced by the actuators of the present invention, mitigation of explosive boiling and the nucleation conditions limiting the likelihood of explosive boiling are relevant considerations.

Figure 11:
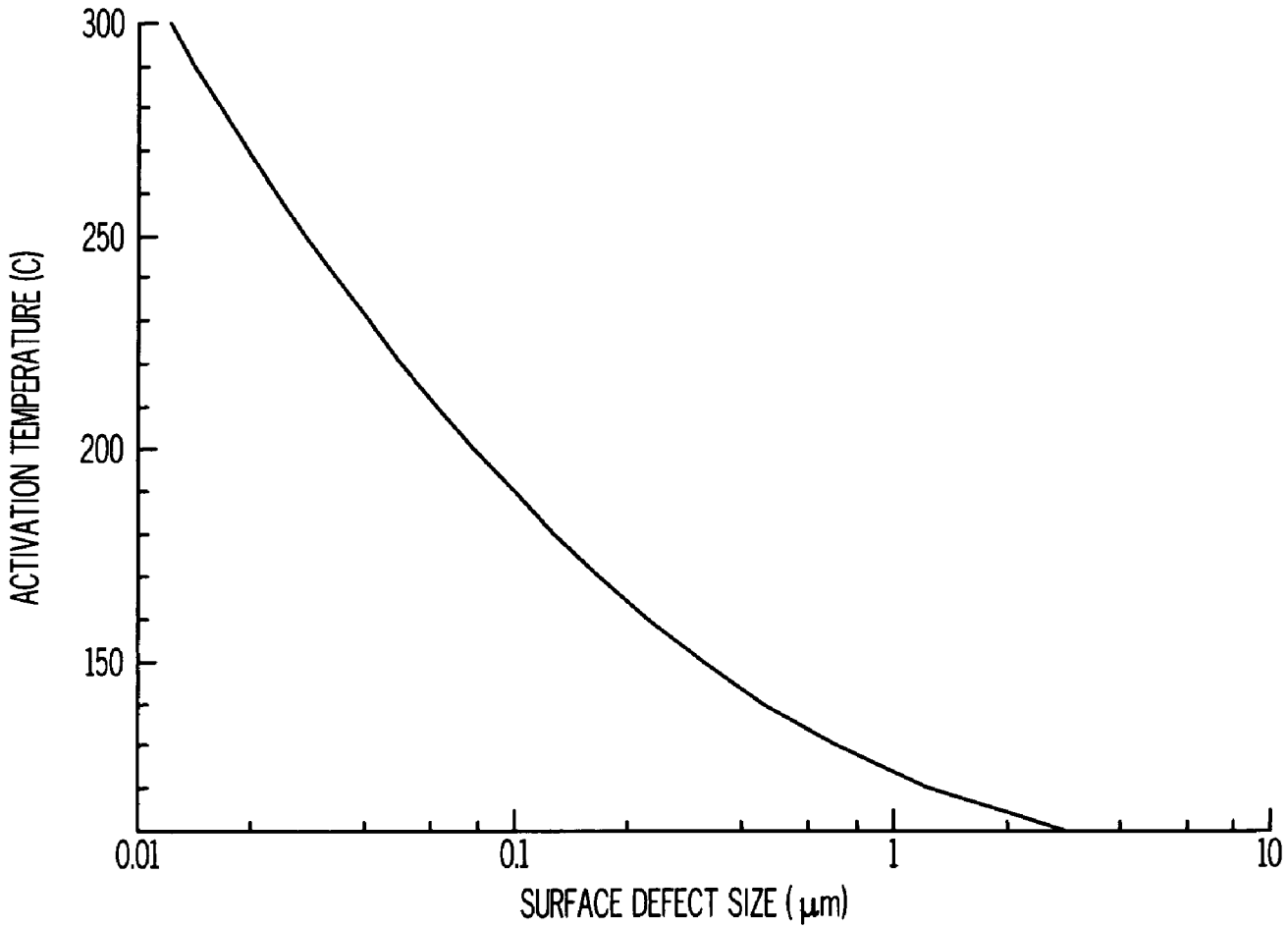
FIG. 11 is a plot showing surface defect size for an exemplary MEMS actuator in accordance with the present invention as a function of activation temperature.

Referencing FIG. 11, an activation curve in accordance with the present invention is computed by combining the Clausius-Clapeyron Equation with the Ideal Gas Law and the Laplace-Young Equation. FIG. 11 graphically shows activation temperature as a function of surface defect size, where liquids adjacent to larger surface defects require less activation temperature to form vapor bubbles. As the activation curve illustrates, temperatures less than 300° C. may be utilized to inhibit explosive boiling for surfaces having defects greater than 0.01 μm. Because the exemplary embodiment in operation will cycle between relatively hot and cooler temperatures to provide the necessary oscillation, the increased temperature associated with expansive deformation of the beam 38, 38', 38" should be kept under 300° C. for beams having surface defect sizes greater than 0.01 μm. It should be understood that surface defects discussed herein refer to a numerically appreciable amount of such defects.

Thus, the surface of the beam 38, 38', 38" should be substantially planar to reduce explosive boiling, as evidenced by FIG. 11. Prevention of explosive boiling conditions will help prevent the formation of vapor bubbles that might otherwise interfere with predictable, repeatable droplet ejection. In addition, erosion of the beam 38, 38', 38" that might result from cavitation may be reduced, thereby extending the useful life and/or efficiency of the actuator 20, 20', 21.

Figure 12:
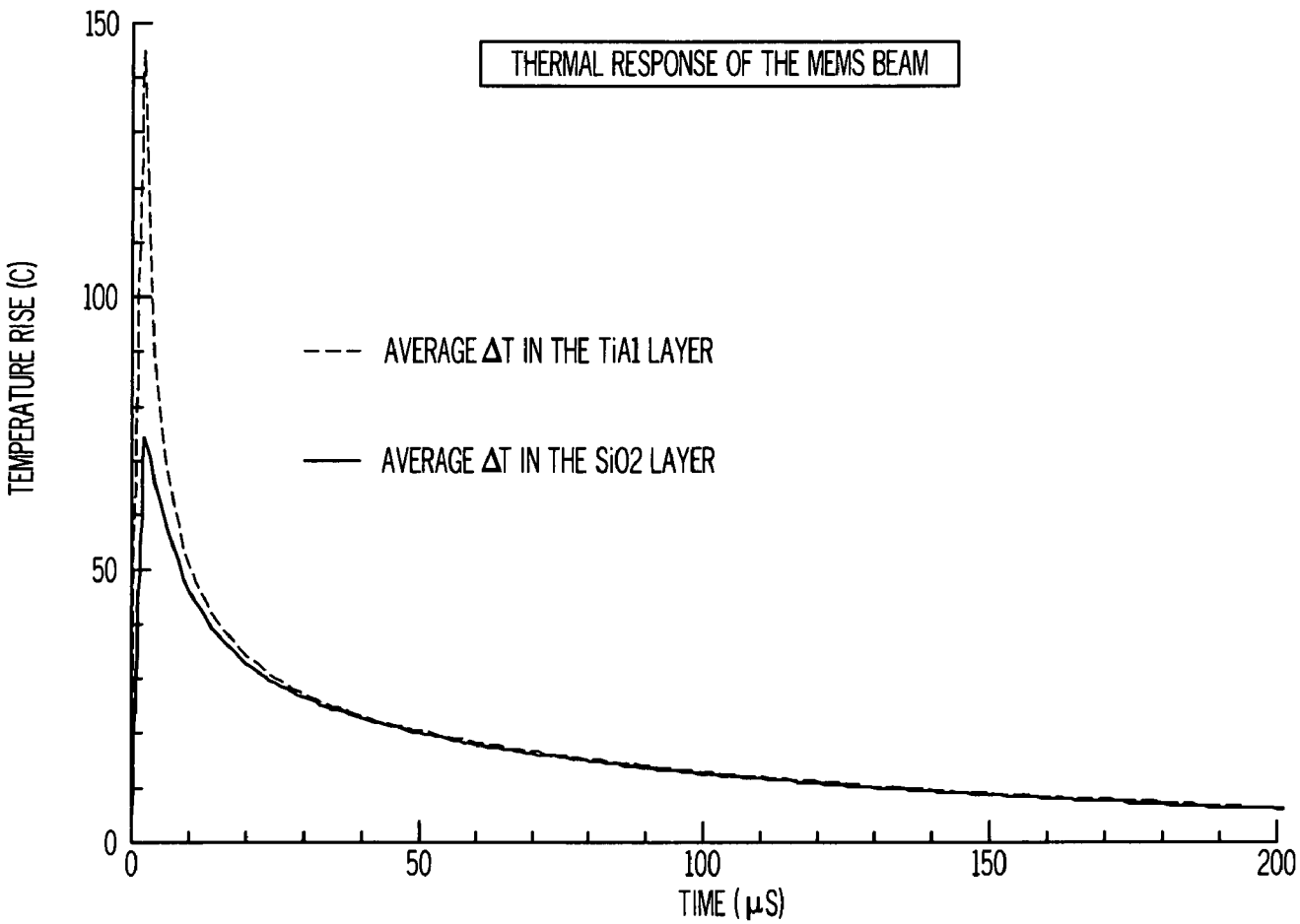
FIG. 12 is a plot in accordance with the present invention showing average temperature in the insulating and resistor layers as a function of time.

Referencing FIG. 12, using the finite element technique, a plot of average temperature of the insulating layer 30 and the resistor layer 22, 22" provides information on available cycle times for actuators 20, 20', 21 in accordance with the present invention. As long as a change in temperature exists between the insulating layer 30 and the resistor layer 22, 22", thermal expansion will displace the beam from its equilibrium position. It is not necessary that the insulating layer 30 and the resistor layer 22, 22" approximate ambient temperature; it is only desired that the change in temperature between the two layers 30, 22, 22" approximates zero. If the present invention were operated where the temperature of both layers were allowed to reach ambient temperature, the actuator 20, 20', 21 would not cycle any faster than once every 200 μs. As discussed above, the present invention need not be operated where each layer reaches ambient temperature. FIG. 12 clearly shows that at approximately 40-50 μs, the temperature difference between the layers approximates zero. Therefore, the present invention may have cycle times approximating 40-50 μs. Thus, the actuators 20, 20', 21 may be operated at frequencies up to approximately 20-25 KHz.

It is well known that the deposition of thin film layers such as TiAl and $SiO_2$ will result in residual stress. Residual stress is built into thin films as a natural consequence of film formation. As such, it becomes more difficult for predictable operation because residual stress will add to the thermal stress that occurs when the beam is heated, which may directly affect the displacement of the beam. One technique to reduce residual stress is annealing, however, annealing a film may have the undesirable consequence of changing the resistivity of the layer 22, 22". Because it is desired to produce a precise volumetric displacement by the application of voltage and pulse width, the variability of resistivity that may be result from annealing is a concern. One way to address residual stress and variable resistivity is to anneal to reduce residual stress and then allow a widened resistivity specification. Thereafter, measuring the electrical resistance of the beam and adjusting at least one of the voltage or pulse width may standardize the joule heating dissipated by the beam. Resistivity will likely vary from lot to lot as a consequence of annealing and, thus, one of the more effective means of measuring beam resistance is in-situ in the printer. An in-situ measurement of beam resistance may be carried out by applying a known current through the resistor layer 22, 22" and measuring the voltage drop across it. Alternatively, beam resistance could also be measured by applying a known voltage across the resistor layer 22, 22" and measuring the current through it. Using either approach, the beam resistance is given as the ratio of voltage/current. Once the resistance of the annealed beam is known, the voltage delivered to it, or the pulse width delivered to it may be adjusted accordingly by the printer.

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A method of designing a microelectromechanical inkjet ejector, the method comprising the steps of:

providing three dimensional measurements of a resistor layer of a microelectromechanical inkjet ejector;

providing a voltage that will be supplied to the resistor layer;

providing information regarding material properties of the resistor layer;

calculating current density taking into consideration the three dimensional measurements, the voltage, and the material properties of the resistor layer; and designing a microelectromechanical inkjet ejector using the calculated current density.

2. The method of claim 1, further comprising the steps of:

providing an energy value that the microelectromechanical inkjet ejector will consume while driven; and calculating a pulse duration during which a microelectromechanical inkjet ejector will be driven taking into consideration the current density;

wherein the step of calculating current density takes into consideration the energy value that the microelectromechanical inkjet ejector will consume while driven.

3. A method of fabricating an apparatus for selective deposition of a fluid onto a substrate, the method comprising the steps of:

forming a repositionable actuator by layering a first material having a first thermal expansion coefficient over a second material having a second thermal expansion coefficient, the first thermal expansion coefficient being greater than the second thermal expansion coefficient, at least one of the first material and the second material being formed to exhibit nonuniform current density between a first point and a second point spaced along a length of the repositionable actuator; and mounting the repositionable actuator to allow movement of the repositionable actuator within a reservoir, the reservoir including an orifice that is adapted to allow selective expelling of a fluid therethrough and onto a print medium;

wherein the repositionable actuator is adapted to displace more than one picoliter per microjoule.

4. A method of operating a printer having a microelectromechanical inkjet ejector operative to displace a particular volume of fluid, the method comprising the steps of:

monitoring print instructions regarding an image to be printed onto a substrate;

determining a volume of fluid to be ejected from a predetermined nozzle of a printer based upon the image to be printed; and manipulating a pulse width applied to a microelectromechanical inkjet ejector in communication with the predetermined nozzle, in response to the step of determining the volume of fluid to be ejected, to eject a droplet of fluid having a predetermined volume onto the substrate.

5. A method of operating a printer having a microelectromechanical inkjet ejector operative to displace a particular volume of fluid, the method comprising the steps of:

monitoring print instructions regarding an image to be printed onto a substrate;

determining a volume of fluid to be ejected from a predetermined nozzle of a printer based upon the image to be printed; and manipulating a voltage applied to a microelectromechanical inkjet ejector in communication with the predetermined nozzle, in response to the step of determining the volume of fluid to be ejected, to eject a droplet of fluid having a predetermined volume onto the substrate.

6. A method of operating a microelectromechanical inkjet ejector to achieve a predetermined mechanical deflection, the method comprising the steps of:

providing a voltage that will drive a microelectromechanical inkjet ejector;

knowing a pertinent volume of a resistor layer of the microelectromechanical inkjet ejector;

knowing an expected temperature field of the microelectromechanical inkjet ejector as a result of being driven;

calculating a pulse width driving the resistor layer of the microelectromechanical inkjet ejector to provide a predetermined mechanical deflection by acknowledging the voltage, the pertinent volume of the resistor layer, and the expected change in the temperature field; and operating the microelectromechanical inkjet ejector using the calculated pulse width to eject a droplet of fluid from a nozzle, wherein the droplet is within a predetermined volume range.

7. The method of claim 6, wherein the calculating step includes the steps of:

calculating a current density of the resistor layer; and calculating a mechanical deflection of the microelectromechanical inkjet ejector utilizing at least in part the current density, the volume of the resistor layer, the voltage, the pulse width, and the expected change in the temperature field of the microelectromechanical inkjet ejector.

8. A method of operating a microelectromechanical inkjet ejector, the method comprising the steps of:

knowing a shape of a microelectromechanical inkjet ejector;

knowing a current driving the microelectromechanical inkjet ejector;

knowing a pulse width of the current driving the microelectromechanical inkjet ejector;

knowing material properties of each material comprising the microelectromechanical inkjet ejector;

calculating the cycle time of the microelectromechanical inkjet ejector using the shape of the microelectromechanical inkjet ejector, the current, the pulse width, and the material properties of each material comprising the microelectromechanical inkjet ejector; and operating the microelectromechanical inkjet ejector using the calculated cycle time to eject a droplet of fluid from a nozzle, wherein the droplet is within a predetermined volume range.

9. The method of claim 8, wherein the step of operating the microelectromechanical inkjet ejector includes the step of operating the microelectromechanical inkjet ejector at a frequency of about between 20 KHz to about 25 KHz.

10. A thermal deformation tool for use in selective deposition of a fluid onto a print medium comprising:

a repositionable actuator including a first material having a first thermal expansion coefficient adjacent to a second material having a second thermal expansion coefficient, the first thermal expansion coefficient being greater than the second thermal expansion coefficient, the repositionable actuator being fabricated to exhibit nonuniform current density between a first point and a second point spaced along a length of the repositionable actuator, wherein a point of maximum deflection of the repositionable actuator is nearer the second point than the first point, wherein the repositionable actuator is subjected to temperature variances causing the first material to expand or contract at a greater rate than the second material, and wherein the repositionable actuator is adapted to displace more than one picoliter per microjoule.

11. The thermal deformation tool of claim 10, wherein the second material includes a first layer and a second layer that sandwich the first material, wherein a thickness of the first layer is greater than ten times a thickness of the second layer.

12. An apparatus for selective deposition of a fluid onto a substrate, the apparatus comprising:

an adaptable beam that includes a cross section along the length thereof comprising a first layer of a first material, a first layer of a second material, and a second layer of a first material, wherein a thickness of the first layer of the first material is greater than ten times a thickness of the second layer of the first material, wherein a thermal expansion coefficient of the second material is greater than a thermal expansion coefficient of the first material; and a chamber adapted to house the adaptable beam at least partially therein, the chamber also adapted to include at least one orifice to allow expelling of a fluid from the chamber by actuation of the adaptable beam upon being subjected to temperature variances.

13. The apparatus of claim 12, wherein:

the second material is a conductor; and the first material is an insulator.

14. The apparatus of claim 13, wherein:

the first material comprises silicon dioxide; and the second material comprises at least one of titanium and aluminum.

15. The apparatus of claim 12, wherein:

the first layer of the first material is between about 4 microns to about 5 microns; and the second layer of the first material is between about 0.1 microns to about 0.4 microns.

16. The apparatus of claim 12, wherein:

the first layer of the first material is between about 3 microns to about 7 microns; and the second layer of the first material is between about 0.03 microns to about 0.6 microns.

17. The apparatus of claim 12, wherein the adaptable beam is adapted to displace more than one picoliter per microjoule.

18. A method of fabricating an apparatus for selective deposition of a fluid onto a substrate, the method comprising the steps of:

forming a repositionable actuator that includes at least three layers:

a first layer comprising a first material having a first thermal expansion coefficient, a third layer comprising a third material having a third thermal expansion coefficient, and a second layer comprising a second material having a second thermal expansion coefficient, wherein the second layer at least partially separates the first layer from the third layer, wherein a thickness of a first layer is greater than ten times a thickness of the third layer; and mounting the repositionable actuator within a reservoir to allow movement of the actuator when subjected to temperature variances by resistive heating to allow selective expelling of a fluid through an orifice of the reservoir and onto a print medium.

19. The method of claim 18, wherein the first layer and the third layer are operative to encapsulate the second layer.

20. The method of claim 18, wherein the second layer at least partially interposes the first layer and the third layer.

21. The apparatus of claim 18, wherein the repositionable actuator is adapted to displace more than one picoliter per microjoule.

22. A method of operating an apparatus for selective deposition of a fluid onto a substrate, the method comprising the steps of:

supplying a reservoir with a fluid, the reservoir including at least one orifice to allow expelling of the fluid from the reservoir, the reservoir at least partially housing an actuator therein; and resistively heating the actuator to reposition the actuator from a first position to a second position, wherein the second position is closer to the orifice than the first position, the actuator including a first insulating layer, a first conductive layer, and a second insulating layer, wherein the first insulating layer is greater than ten times a thickness of the second insulating layer and the first conductive layer at least partially separates the first insulating layer from the second insulating layer, wherein the first insulating layer is nearer to the orifice than the second insulating layer, and wherein the actuator is adapted to displace more than one picoliter per microjoule.

23. A thermal deformation tool for use in selective deposition of a fluid onto a print medium comprising:

an adaptable beam comprising a first material having a first thermal expansion coefficient at least partially encased by a second material having a second thermal expansion coefficient, the first thermal expansion coefficient being greater than the second thermal expansion coefficient the adaptable beam having a length greater than a width and a height thereof, a cross section along the length of the adaptable beam comprising a first layer of the first material, a first layer of the second material, and a second layer of the first material, wherein a thickness of the first layer of the first material is greater than ten times a thickness of the second layer of the first material.

24. The tool of claim 23, wherein:

the first material is an insulator; and the second material is a conductor.

25. The tool of claim 24, wherein:

the first material comprises silicon dioxide; and the second material comprises at least one of titanium and aluminum.

26. The tool of claim 23, wherein:

the first layer of the first material is between about 3 microns to about 7 microns; and the second layer of the first material is between about 0.03 microns to about 0.7 microns.

27. The tool of claim 23, wherein:

the first layer of the first material is between about 4 microns to about 5 microns; and the second layer of the first material is between about 0.1 microns to about 0.4 microns.

28. The apparatus of claim 23, wherein the adaptable beam is adapted to displace more than one picoliter per microjoule.

29. A method for operating an apparatus adapted for selective deposition of a fluid onto a substrate, the apparatus comprising:

providing a chamber adapted to house a repositionable beam at least partially therein, the chamber also including at least one orifice; and oscillating the repositionable beam between a first position and a second position to allow expelling of a fluid from the chamber through the orifice by movement of the repositionable beam, the repositionable beam comprising a first material having a first thermal expansion coefficient adjacent to a second material having a second thermal expansion coefficient, the first thermal expansion coefficient being less than the second thermal expansion coefficient;

wherein the oscillating step includes the step of heating the repositionable beam such that a surface temperature of the repositionable beam does not exceed about 300 degrees Celsius.

30. The apparatus of claim 29, wherein the repositionable beam is adapted to displace more than one picoliter per microjoule.

31. An apparatus for selective deposition of a fluid onto a substrate, the apparatus comprising:

an oscillating beam comprising a first material having a first thermal expansion coefficient adjacent to a second material having a second thermal expansion coefficient, the first thermal expansion coefficient being less than the second thermal expansion coefficient, wherein the oscillating beam has a nonuniform current density and has surface pores less than between about 0.1 microns and about 0.01 microns in depth; and a chamber adapted to house the adaptable beam at least partially therein, the chamber also adapted to include at least one orifice for expelling a fluid from the chamber by actuation of the oscillating beam.

32. The apparatus of claim 31, wherein the oscillating beam includes surface pores ranging between about 0.07 microns to about 0.01 microns.

33. The apparatus of claim 31, wherein the oscillating beam includes surface pores ranging between about 0.06 microns to about 0.02 microns.

34. The apparatus of claim 31, wherein the oscillating beam is adapted to displace more than one picoliter per microjoule.

35. A method of operating a microelectromechanical inkjet ejector to eject a particular volume of ink, the method comprising the steps of:

determining a current density for each element of the microelectromechanical actuator;

determining Joule heating for each element of the microelectromechanical actuator;

calculating a voltage applied to the microelectromechanical actuator to displace a predetermined volume droplet from a nozzle of a printer by factoring in the current density and Joule heating; and applying the voltage calculated to the microelectromechanical actuator to eject a droplet of fluid from a nozzle, wherein the droplet is within a predetermined volume range.

36. The method of claim 35, further comprising the steps of:

calculating an electric field in the microelectromechanical actuator;

assigning a resistivity value to each element of the microelectromechanical actuator;

calculating a current density distribution of the microelectromechanical actuator using the resistivity and electric field;

calculating a current through the microelectromechanical actuator based upon the current density; and calculating a transient temperature field of the microelectromechanical actuator using the current density;

wherein the transient temperature field is factored into the step of determining the Joule heating.

37. The method of claim 36, wherein:

the step of calculating the electric field in the microelectromechanical actuator includes using the equation:

$$\frac{\partial}{\partial x}\left(\frac{1}{\rho_x}\frac{\partial\Phi}{\partial x}\right)+\frac{\partial}{\partial y}\left(\frac{1}{\rho_y}\frac{\partial\Phi}{\partial y}\right)=0$$

where, ρ=resistivity value, and Φ=electrical potential; and the step of calculating the current density for each element of the microelectromechanical actuator includes using the equation:

$$J=\frac{1}{\rho}\nabla\Phi$$

where, J=current density, ρ=resistivity value, and ∇Φ is electrical potential gradient.

38. A method of operating a microelectromechanical inkjet ejector to eject a particular volume of ink, the method comprising the steps of:

determining a current density for each element of a microelectromechanical actuator;

determining Joule heating for each element of the microelectromechanical actuator, taking into consideration the current density for each element of the microelectromechanical actuator;

calculating a pulse width, to be applied to the microelectromechanical actuator to displace a predetermined volume droplet from a nozzle of a printer, taking into consideration the Joule heating for each element of the microelectromechanical actuator; and applying a pulse to the microelectromechanical actuator using the pulse width calculated to eject a droplet of fluid from a nozzle, wherein the droplet is within a predetermined volume range.

39. The method of claim 38, wherein the step of determining Joule heating includes the steps of:

assigning a resistivity value to each element of the microelectromechanical actuator; and calculating a current through the microelectromechanical actuator, taking into consideration the current density for each element of the microelectromechanical actuator and the resistivity value of each element of the microelectromechanical actuator;

wherein the Joule heating for each element of the microelectromechanical actuator is determined taking into consideration the current through the microelectromechanical actuator.

40. The method of claim 38, wherein the step of determining current density includes the step of calculating a nonuniform current density.

41. The method of claim 38, wherein;

the step of determining current density includes the step of calculating the electric field in a microelectromechanical actuator using the equation:

$$\frac{\partial}{\partial x}\left(\frac{1}{\rho_x}\frac{\partial \Phi}{\partial x}\right)+\frac{\partial}{\partial y}\left(\frac{1}{\rho_y}\frac{\partial \Phi}{\partial y}\right)=0$$

where, ρ=resistivity value, and Φ=electrical potential; and the step of calculating current density for each element of the microelectromechanical actuator includes using the equation:

$$J=\frac{1}{\rho}\nabla\Phi$$

where, J=current density, ρ=resistivity value, and ∇Φ is electrical potential gradient.

42. A method of operating a microelectromechanical inkjet ejector to eject a particular volume of ink, the method comprising the steps of:

measuring, in-situ, the electrical resistance of a microelectromechanical inkjet ejector; and adjusting at least one of a voltage delivered to the microelectromechanical inkjet ejector and a pulse width applied to the microelectromechanical inkjet ejector to maintain joule heating of the microelectromechanical inkjet ejector within a predetermined range.

43. An apparatus adapted for use in selective deposition of a fluid onto a substrate, the apparatus comprising:

a plurality of micromachined inkjet ejectors arranged to operatively provide a vertical resolution of at least 300 dots per inch, wherein each micromachined inkjet ejector comprises a first material having a first thermal expansion coefficient at least partially encased by a second material having a second thermal expansion coefficient, the first thermal expansion coefficient being greater than the second thermal expansion coefficient, and each micromachined inkjet ejector having a length greater than a width and a height thereof, a cross section along the length of the adaptable beam comprising a first layer of the first material, a first layer of the second material, wherein a thickness of the first layer of the first material is greater than ten times a thickness of the second layer of the first material.

* * * * *